US007836948B2

(12) United States Patent
Kusko et al.

(10) Patent No.: US 7,836,948 B2
(45) Date of Patent: Nov. 23, 2010

(54) FLOW HYDRAULIC AMPLIFICATION FOR A PULSING, FRACTURING, AND DRILLING (PFD) DEVICE

(75) Inventors: David John Kusko, Houston, TX (US); Gabor Vecseri, Houston, TX (US); Daniel Maurice Lerner, Missouri City, TX (US)

(73) Assignee: Teledrill Inc., Katy, TX (US)

( * ) Notice: Subject to any disclaimer, the term of this patent is extended or adjusted under 35 U.S.C. 154(b) by 159 days.

(21) Appl. No.: 12/004,121

(22) Filed: Dec. 20, 2007

(65) Prior Publication Data

US 2008/0271923 A1 Nov. 6, 2008

Related U.S. Application Data

(60) Provisional application No. 60/927,400, filed on May 3, 2007.

(51) Int. Cl.
*E21B 28/00* (2006.01)

(52) U.S. Cl. ..... 166/249; 166/177.5

(58) Field of Classification Search ..... 166/249, 166/308.1, 177.5, 177.6; 367/83, 84; 340/854.3
See application file for complete search history.

(56) References Cited

U.S. PATENT DOCUMENTS 2,352,833 A * 7/1944 Hassler ..... 367/83
3,958,217 A 5/1976 Spinnler
4,901,290 A 2/1990 Feld et al.
5,009,272 A 4/1991 Walter
5,040,155 A 8/1991 Feld
5,190,114 A 3/1993 Walter
5,508,975 A 4/1996 Walter
5,517,464 A * 5/1996 Lerner et al. ..... 367/84
5,626,016 A 5/1997 Walter
6,053,261 A 4/2000 Walter
6,082,473 A 7/2000 Dickey
6,102,138 A 8/2000 Fincher
6,237,701 B1 5/2001 Kolle et al.
6,279,670 B1 8/2001 Eddison et al.
6,338,390 B1 1/2002 Tibbetts
6,439,316 B1 8/2002 Penisson
6,508,317 B2 1/2003 Eddison et al.
6,588,518 B2 7/2003 Eddison
6,668,948 B2 12/2003 Buckman, Sr. et al.
6,840,337 B2 1/2005 Terry et al.
6,997,272 B2 2/2006 Eppink
7,011,156 B2 3/2006 von Gynz-Rekowski (Continued)

*Primary Examiner*—David J Bagnell
*Assistant Examiner*—Catherine Loikith
(74) *Attorney, Agent, or Firm*—Guerry L. Grune

(57) ABSTRACT

A device and method and/or system for generating pulses to improve drilling rates, the ability to drill straighter and farther by increasing fracturing or injection efficiencies in a geological formation that may contain desirable hydrocarbons. This system can be used in other types of drilling or fracturing operations, whether to unclog arteries or to open formations for underground storage in conjunction with pulsing/fracturing and create large pulses downhole for seismic purposes. The system and method comprises several pulse generating devices longitudinally and axially positioned within upper, middle, lower, and outer annular drill collar flow channels or packer isolation mechanisms such that the PFD medium flows through the various annular drill collar flow channels and the PFD medium is guided into one or more sets of selectively reversible flow connecting channels, wherein the connecting channels are connected to guide pole channel allowing for controlling pulsing within the geological formation.

18 Claims, 14 Drawing Sheets

U.S. PATENT DOCUMENTS

| | | | |
|---|---|---|---|
| 7,032,689 | B2 | 4/2006 | Goldman et al. |
| 7,051,821 | B2 | 5/2006 | Samuel |
| 7,100,708 | B2 | 9/2006 | Koederitz |
| 2003/0196836 | A1 | 10/2003 | Larsen et al. |
| 2004/0108138 | A1 | 6/2004 | Cooper et al. |
| 2004/0156265 | A1* | 8/2004 | Lavrut et al. ..... 367/83 |
| 2005/0121235 | A1 | 6/2005 | Larsen et al. |
| 2006/0076163 | A1 | 4/2006 | Terracina et al. |

* cited by examiner

FLOW HYDRAULIC AMPLIFICATION FOR A PULSING, FRACTURING, AND DRILLING (PFD) DEVICE

Applicant hereby claims priority benefit under Title 35, United States Code 119(e) of previously filed U.S. Provisional application No. 60/927,400, filed 3 May 2007.

FIELD OF DISCLOSURE

The current invention includes an apparatus and a method for creating a hydraulically amplified pulse within pulsing, fracturing, and drilling (PFD) medium (fluid or gas), generally known as drilling mud, fracturing fluid, injection fluids, or gas, etc. that is generated by selectively initiating flow driven bi-directional pulses. The present disclosure describes devices relating to flow pulsing methods and apparatus for use in various applications, such as in: down-hole drilling equipment and in particular to an improved flow pulsing method and apparatus of this type adapted to be connected in a drill string above a drill bit for securing improvements in the overall drilling process; fracturing the formation through perforations or liners or while drilling due to the hydraulic amplification of the PFD device; injection of fluids or gases for tertiary recovery or other sorts of injections requiring hydraulic amplification for delivery purposes; sending out large pulses downhole that could be read in nearby wells for seismic mapping.

Features of the device include operating a flow throttling device (FTD) within a specially designed annular drill collar flow channel (upper, middle, outer, and lower). The pulse is used for; the reduction of "stick-slip"; increased rate of penetration of the drill bit due to the hammer-like pulsation and increased jetting action caused by the hydraulic amplification of the drilling fluid; removal of cuttings from the annular drill collar flow channel behind the drill string; and optionally, an increase of the hydraulic fracturing pressure downhole at the formation of interest. In the case of fracturing or injection pressure, the number of uphole pumps for this process could be conceivably reduced to one. Use of a gamma ray detector, pressure or other formation sensors at or above the drill bit is also a portion of the present disclosure and can be used in conjunction with the pulsing mechanism for the capture and transmittal of formation information.

BACKGROUND

Current MWD pulser technology includes pulsers that are sensitive to different fluid pump down hole pressures, and flow rates, and requires field adjustments to pulse properly. These pulsers deliver fairly low amplitude pressure pulses for the amount of energy they use to engage. "Stick-slip" is a well known phenomenon that refers to a situation that occurs when the lower part of the drill string & the drill bit, which is normally rotating with the drill string, gets stuck "stick" in the formation and the drill string continues to rotate rapidly building up torque that eventually causes the drill bit to rotate excessively "slip" and to stop again to the point that it wears out the bit prematurely and decreases the rate of drilling. The pulse magnitude and axial jerk of our PFD device will reduce or eliminate "stick slip."

Coiled tubing drill strings with downhole motors powered by drilling fluids are restricted by the amount of pressure that can be tolerated inside the coiled tubing. The axial jerk on the bit and hydraulic amplification of this flow throttling device (FTD) allows for increased jetting and removal of cuttings at the bit, where the pressure pulses and weight on the bit are most needed.

Increased rate of penetration of the drill bit leads to lower drilling costs. The increased jetting action clears away the cuttings during drilling which may cause the drill string to become stuck in the hole if not removed from the annular drill collar flow channel between the drill pipe and the formation. Removing these cuttings will reduce the NPT (non-productive time) associated with the drill string getting stuck in the hole when cuttings build up. The flow throttling device (FTD) may optionally be set so that the pressure pulses downhole are hydraulically amplified so that the formation is fractured to increase the permeability of the formation of interest and extend the flow channels further outward away from the drill bore, thus increasing the surface area of the formation from which hydrocarbons can be produced. This fracturing while drilling or after drilling (with a formation isolation mechanism similar to a pack which will be referred to as a packer isolation mechanism (PIM)) can be used selectively, depending on whether the operator wants to produce the well while drilling, or fracture the formation of interest through liners or perforations subsequent to the drilling operation. Use of a single uphole pump (frac truck) may be possible in this case and this represents a dramatic capital and labor savings uphole compared with conventional technology. Since the pulses can be adjusted to be large enough to be read uphole through an annular pressure transducer, the use of a gamma ray detector directly above the bit in conjunction with the pulser can be used to maintain the drill string within the formation of interest. The gamma ray detector is located several feet above the drill bit so that when the bit strays outside the formation of interest, the driller can more quickly correct direction and thereby maximize the time within the pay zone.

Because the bottom hole assembly is typically in compression, the FTD, will also, for a short period of time, release some of that compression on the drill string when it generates its large pressure pulse downhole, similar to a snake coiling and uncoiling. This coiling and uncoiling effect known as "axial jerk" also produces the added benefit of drilling a straighter hole. Additionally, the FTD will have a tendency to "pick" forward straight through formation induced deviations. The benefits of drilling a straighter hole include allowing for the FTD to spend less time stuck in the hole; more accurate placement of the bit into the formation of interest thus enhancing recovery efficiencies; less time correcting direction when the drill string wanders off course; less mechanical inefficiencies caused by the drill string rubbing against the side of the 20 hole if the hole is not vertical; less wear on the drill string during drilling; and an overall increase in the ROP (rate of penetration) primarily due to drilling a straighter hole.

Among the many advantages of the present disclosure are that it includes embodiments of devices with decreased sensitivity to fluid flow rate or pressure within limits, does not require field adjustment, and is capable of creating recognizable, repeatable, reproducible, clean (i.e. noise free) fluid pulses using minimum power due to a unique flow throttling devices (FTD) that may partially be powered by magneto-electric and turbine generated energy systems as well as a unique pilot flow channel design. The annular drill collar flow channel is specifically designed such that Tprimarily laminar flow exists in the area where the pulse occurs. Additional pulsers with varying pressure amplitudes and/or frequencies are easily added to enable an exponential increase in the bit amplitude and/or pulse rate.

Additionally, in comparison with earlier devices designed for addressing the same or similar needs, the devices of the present disclosure provide larger pressure pulses due to the fact that the design allows for closing of 100% of the fluid flow stream with a pulser bell portion of the flow throttling device (FTD). Other earlier developed devices possess different failure mechanisms that include closing valves and utilizing operating springs with by-pass channels, which are unnecessary for the devices of the present disclosure. In fact, the failure mechanism for the devices of the present disclosure includes a flow throttling device (FTD) that exists in the open state when not functioning. The need for a by-pass channel design is optional for the present devices.

The present disclosure includes devices which provide a higher bit rate and potentially more easily controlled pulses which can utilize downhole pressure transducers that are energized with an electrical circuitry control package. Instead of valves, the flow throttling devices (FTD's) utilized allow for a more controlled opening of channels for the fluid flow and therefore the frequency, duration, and amplitude of the pulses can be provided as needed by a knowledgeable operator. The amplitude may be adjusted by keeping the pulser bell from closing off fluid channel flow completely. In fact, the bell itself may provide channel opening and closing vents or ducts.

The pulse generated by the present devices also is not required to be periodic, but could be "aperiodic" in that the residence frequency is also controllable. In addition, it is possible to design these devices such that they are in combination with a gamma ray or other sensor system detectors which also utilize the electrical circuitry control package.

It is a general object of the present disclosure to provide improved flow pulsing methods and apparatus for various applications wherein vibrating and/or flow pulsing effects are desired, for example, vibrating a drill string and a drill bit to increase the drilling rate and to pulse the flow of drilling fluid emitting from the drill bit jets thereby to enhance the cleaning effect and the drilling rate.

An additional objective is to provide apparatus that would allow the continuation of the drilling process without the benefit of the pulsating flow, in the event that the restricting member fails in operation and remains in the opened position.

Accordingly, the present disclosure in one aspect provides a flow pulsing apparatus including a housing providing a passage for a main flow of fluid and a means for periodically interrupting the flow through main passage to create pulsations in the flow with a time delay between pulses and a cyclical water-hammer effect to vibrate the drill string during use.

DESCRIPTION OF PERTINENT ART

The present invention discloses a novel device for creating pulses in drilling fluid media flowing through a drill string near or at the drill bit. Devices currently in use require springs or other techniques to assist in creating pulses.

U.S. Pat. No. 7,100,708; to Koederitz, William I.; and assigned to Varco I/P, Inc., describes a method for controlling the placement of weight on a bit of a drilling assembly during the start of a drilling operation with the method comprising the steps of; establishing a set point for a parameter of interest related to the placement of weight on the bit; monitoring the parameter of interest and increasing actual weight on bit in a gradual manner until the set point is reached for the parameter of interest. The weight on bit is increased in a gradual manner by establishing a plurality of intermediate set points below the set point and sequentially moving the weight on bit along the intermediate set points.

U.S. Pat. No. 7,051,821; to Samuel, Robello; and assigned to Halliburton, describes a method of cleaning a hole in a subterranean formation comprising rotating a drillstring to drill a hole through the subterranean formation. The drillstring includes at least one cleaning device while rotating the drillstring and circulating fluid through the drillstring into the hole. In response to an increase in a hydrostatic pressure of the fluid in the drillstring, at least one adjustable vane is extended away from the cleaning device to clean accumulated cuttings from the drilled hole.

U.S. Pat. No. 7,032,689; to Goldman, et. al.; and assigned to Halliburton, describes an apparatus for predicting the performance of a drilling system comprising a first input device for receiving data representative of a geology characteristic of a formation per unit depth wherein the geology characteristic includes at least rock strength; a second input device for receiving data representative of specifications of proposed drilling equipment of the drilling system for use in drilling a well bore in the formation wherein the specifications include at least a specification of a drill bit. Additionally a processor is operatively connected to the first and second input devices for determining a predicted drilling mechanics in response to the specifications data of the proposed drilling equipment as a function of the geology characteristic data per unit depth according to a drilling mechanics model and outputting data representative of the predicted drilling mechanics. The predicted drilling mechanics includes at least one selected from the group consisting of bit wear, mechanical efficiency, and power and operating parameters. The processor further outputs control parameter data responsive to the predicted drilling mechanics data wherein the control parameter data is adaptable for use in a recommended controlling of a control parameter in drilling of the well bore with the drilling system. The control parameter includes at least one selected from the group consisting of weight-on-bit, rpm, pump flow rate, and hydraulics. Included is a third input device for receiving data representative of a real, time measurement parameter during the drilling of the well bore where the measurement parameter includes at least one selected from the group consisting of weight-on-bit, rpm, pump flow rate, and hydraulics. The processor is further operatively connected to the third input device and configured for history matching the measurement parameter data with a back calculated value of the measurement parameter data wherein the back calculated value of the measurement parameter data is a function of the drilling mechanics model and at least one control parameter and therein responsive to a prescribed deviation between the measurement parameter data and the back calculated value of the measurement parameter data. The processor is configured to perform at least one selected from the group consisting of; adjust the drilling mechanics model and modifying the control parameter data of a control parameter.

U.S. Pat. No. 7,011,156; to von Gynz-Rekowski, Gunther H H; and assigned to Ashmin, L C, describes a tool for delivering an impact comprising a cylindrical member having an internal bore, a first anvil and a first rotor disposed within the internal bore of the cylindrical member. The first rotor has an outer circumference with a first profile and contains an internal portion, a radial hammer face and a first sleeve disposed within the internal bore of the cylindrical member. The first sleeve has a top radial face containing a second profile that cooperates with the first profile. The first rotor has a position relative to the first sleeve wherein the first profile cooperates with the second profile so that the first radial hammer face contacts the first anvil and the first rotor has another position relative to the first sleeve wherein the first profile cooperates with the second profile so that the first radial hammer face is separated from the first anvil.

U.S. Pat. No. 6,997,272; to Eppink, Jay M.; and assigned to Halliburton, describes an assembly for drilling a deviated borehole from the surface using drilling fluids comprising a bottom hole assembly connected to a string of coiled tubing extending to the surface having a flowbore for the passage of drilling fluids. The bottom hole assembly includes a bit driven by a downhole motor powered by the drilling fluids, the bottom hole assembly and string forming an annulus with the borehole, a surface pump at the surface to pump the drilling fluids downhole, a first cross valve associated with the surface pump providing a first path directing drilling fluids down the flowbore and a second path directing drilling fluids down the annulus. A second cross valve adjacent the bottom hole assembly has an open position allowing flow through an opening between the flowbore and the annulus above the downhole motor and a closed position preventing flow through the opening. There is a first flow passageway directing drilling fluids through the first path, through the bottom hole assembly, and then up the annulus; and a second flow passageway directing drilling fluids through the second path, through the opening, and then up the flowbore.

U.S. Pat. No. 6,840,337; to Terry, et. al.; and assigned to Halliburton, describes an apparatus for removing cuttings in a deviated borehole using drilling fluids. The apparatus comprises a pipe string; a bottom hole assembly having a down hole motor and bit for drilling the borehole. The pipe string has one end attached to the bottom hole assembly; the pipe string being non-rotating during drilling and a means for raising at least a portion of the pipe string in the deviated borehole to remove cuttings from underneath the pipe string portion. The pipe string portion is disposed in the deviated borehole significantly uphole of the bottom hole assembly.

U.S. Pat. No. 6,668,948; to Buckman, et. al.; and assigned to Buckman Jet Drilling, Inc., describes a nozzle for jet drilling, comprising a body having an inlet end and an outlet end. The inlet end has a connector mechanism and the body has a longitudinal axis and forming an inlet chamber adjacent the inlet end. There is a disk for imparting swirling motion to the fluid inside the body with the disk disposed between the inlet chamber and a second chamber. The second chamber has an outlet and the disk has a plurality of orifices therethrough. At least one of the orifices is directed at a selected tangential angle with respect to the longitudinal axis for imparting a swirling motion to fluid in the second chamber. There is a front orifice forming the outlet of the second chamber with the front orifice having a selected diameter and an extension affixed to the outlet end of the body. The extension has an interior surface for confining fluid in a radial direction with the interior surface having a diameter greater than the diameter of the front orifice.

U.S. Pat. No. 6,588,518; to Eddison, Alan Martyn; and assigned to Andergauge Limited, describes a downhole drilling method comprising producing pressure pulses in drilling fluid using measurement-while-drilling (MWD) apparatus in a drill string having a drill bit and allowing the pressure pulses to act upon a pressure responsive device to create an impulse force on a portion of the drill string. The impulse force is utilized to provide a hammer drilling effect at the drill bit.

U.S. Pat. No. 6,508,317; to Eddison, et. al.; and assigned to Andergauge Limited, describes a flow pulsing apparatus for a drill string comprising a housing for location in a drill string above a drill bit. The housing defines a throughbore to permit passage of drilling fluid and a valve located in the bore, including first and second valve members, each defining a respective axial flow opening and which openings are aligned to collectively define an open axial drilling fluid flow port. The first member is rotatable about a longitudinal axis of the housing to vary the alignment of the openings between a first alignment in which the openings collectively define an open axial flow port of a first open area and a second alignment in which the openings collectively define an open axial flow port of a second open area greater than the first open area to, in use, provide a varying flow therethrough and variation of the drilling fluid pressure and drive means operatively associated with the valve for rotating the first member.

U.S. Pat. No. 6,439,316; to Penisson, Dennis; and assigned to Bilco Tools, Inc., describes a safety system for controlling operation of a power tong used to make up and break apart a threaded oilfield tubular connection. The power tong includes a tong frame having a frame open throat, a rotary ring rotatably supported on the tong frame and having a ring open throat. There is a door supported on the tong frame for opening to laterally move the power tong on and off the oilfield tubular connection and for closing over the frame open throat when the oilfield tubular connection is within the rotary ring, and a hydraulic motor supported on the tong frame for rotating the rotary ring. The safety system comprises a motor control valve operable to control flow of pressurized fluid from a hydraulic power source to the hydraulic motor, a switch supported on the tong frame for outputting a signal in response to the position of the door with respect to the tong frame, a valve operator for controlling operation of the motor control valve, a fluid pressure responsive member for automatically engaging and disengaging operation of the valve operator and thus the motor control valve. The fluid pressure responsive member is biased for disengaging operation of the motor control valve and a safety control line for interconnecting to the switch and the fluid pressure responsive member such that the switch engages operation of the valve operator by transmitting a closed door signal to the valve operator when the door is closed and the switch disengages operation of the valve operator by transmitting an open door signal to the valve operator when the door is open.

U.S. Pat. No. 6,338,390; to Tibbitts, Gordon A.; and assigned to Baker Hughes, Inc., describes an earth drilling device for variably contacting an earth formation comprising a near bit sub member configured for attachment to the downhole end of a drill string. There is a bit body attached to the near-bit sub member with the bit body having fixed cutting elements secured thereto and positioned to contact an earth formation. An apparatus associated with the near-bit sub member for produces a variable depth of cut by the fixed cutting elements into the earth formation while the bit body is rotated by the drill string. The apparatus is structured to provide axial movement of the bit body relative to the near-bit sub member to produce a variable depth of cut by the fixed cutting elements into the earth formation during drilling. The apparatus comprises a lower member attached to the bit body and an upper member spaced from the lower member and biased with respect thereto by a resilient member providing movement of the lower member relative to the upper member.

U.S. Pat. No. 6,279,670; to Eddison, et. al.; and assigned to Andergauge Limited, describes a downhole flow pulsing apparatus for providing a percussive effect comprising a housing for location in a string. The housing defines a throughbore to permit passage of fluid therethrough. A valve located in the bore defines a flow passage and includes a valve member. The valve member is movable varying the area of the flow passage to, in use, provide a varying fluid flow therethrough. A fluid actuated positive displacement motor operatively associated with the valve drives the valve member and a pressure responsive device which expands or retracts in response to the varying fluid pressure created by the varying fluid flow and the expansion or retraction providing a percussive effect.

U.S. Pat. No. 6,237,701; to Kolle, et. al.; and assigned to Tempress Technologies, Inc., describes an apparatus for generating a suction pressure pulse in a borehole in which a pressurized fluid is being circulated comprising a valve having an inlet port, an outlet port, and a drain port. The inlet port of the valve is adapted to couple to a conduit through which the pressurized fluid is conveyed down into the borehole. The valve, including a first member, that is actuated by the pressurized fluid to cycle between an open state and at least a partially closed state and the first member, while in the at least partially closed state, partially interrupts a flow of the pressurized fluid through the outlet port so that at least a portion of the flow of the pressurized fluid is redirected within the valve without completely interrupting the flow of the pressurized fluid into the inlet port. The pressurized fluid that was redirected within the valve when the first member was last in the at least partially closed state subsequently flows through the drain port and back up the borehole. A high velocity flow course is coupled in fluid communication with the outlet port of the valve. Having an inlet and an outlet, the suction pressure pulse is generated when the first member is in the at least partially closed state by substantially reducing the flow of the pressurized fluid through the high velocity flow course.

U.S. Pat. No. 6,102,138; to Fincher, Roger W.; and assigned to Baker Hughes, Inc., describes a downhole drilling assembly comprising a downhole motor supported on tubing with a bit driven by the motor, a thruster mounted to the tubing which extends in length for application of a desired weight on the bit and a compensating device to compensate for pressure change in the tubing caused by the bit or the motor to allow proper functioning of the thruster.

U.S. Pat. No. 6,082,473; to Dickey, Winton B.; and unassigned, describes a non-plugging nozzle comprising a body having a top, a bottom, and an axis. The body defines a central passageway extending therethrough from the top to the bottom in an axial direction so that the body has a side wall and a central passageway defining an inlet aperture at the top of the body, an exit aperture at the bottom of the body and a cylindrical portion. The body also defines a side passageway extending through the side wall intermediate the top and bottom of the body. The side passageway is in flow communication with the central passageway and intersecting the cylindrical portion. There is a side inlet orifice formed at the intersection of the side passageway and the central passageway with the side inlet orifice substantially squared to prevent plugging of the nozzle and an attachment mechanism wherein the body is removeably attached to a drill bit.

U.S. Pat. No. 6,053,261; to Walter, Bruno H.; and unassigned, describes an apparatus for effecting pulsations in a flow of liquid comprising an elongated hollow housing defining a primary flow passage adapted to carry a flow of liquid axially therealong, an elongated conduit having an upstream end and a downstream end extending within the housing and defining a main flow passage interiorly of the conduit which communicates at its downstream end with said primary flow passage and a by-pass flow passage extending lengthwise of the conduit from the upstream end to the downstream end thereof. There is a nozzle located in the hollow housing adjacent to and spaced from the upstream end of the conduit adapted to discharge flow passing along the primary passage into the main flow passage defined by the conduit. The space between the nozzle and the upstream end provides communication between the main flow passage and the by-pass flow passage. An axially movable valve member located in the downstream end of the conduit and co-operating with a valve seat located downstream of the valve member interrupts the flow through the conduit. There is one or more passages downstream of the valve seat providing communication between the main flow passage and the by-pass passage in a region downstream of the valve seat. There is a spring for urging the valve member toward an open position in the upstream direction. The valve member is adapted to move to a closed position in response to flow along the valve member thus interrupting the flow through the conduit creating a water hammer pulse which travels upstream through the conduit and the nozzle and also through the space between the nozzle and the upstream end of the conduit. The pulse also travels downstream along the by-pass passage and through the further passage(s) to the region downstream of the valve member thus tending to momentarily equalize water hammer pressures on upstream and downstream sides of the valve member. The spring is adapted to move the valve member away from the seat under these equalized pressures whereupon flow within the conduit again commences thus again effecting the closure of the valve member whereupon the above recited sequence of events is repeated to produce a cyclical water hammer and flow pulsating effect.

U.S. Pat. No. 5,626,016; to Walter, Bruno H.; and unassigned, describes a method for shaking a structure relative to a member comprising the steps of: providing a driving system and a deformable hollow element comprising:

i) a conduit having an inlet and an outlet;
ii) a source of pressurized fluid having an output pressure, connected to the inlet;
iii) a valve in the conduit;
iv) a valve actuator associated with the valve for repeatedly opening and closing the valve.

The hollow element comprises a deformable wall enclosing a fluid-filled cavity and first and second mounting points on the deformable wall. A change in a fluid pressure in the fluid-filled cavity causes the second mounting point to move relative to the first mounting point; connecting the first mounting point to a structure to be vibrated relative to a member and connecting the second mounting point to the member and opening the valve and holding the valve open until the fluid flows through the conduit with a velocity sufficient to create a water hammer within the conduit. Suddenly closing the valve creates a water hammer within the conduit comprising a pressure pulse having a pressure significantly greater than the output pressure;

allowing the water hammer pressure pulse to propagate into the cavity in the hollow element to increase the fluid pressure inside the cavity;

allowing a change in the fluid pressure in the cavity to cause the first mounting point to move relative to the second mounting point thereby moving the structure relative to the member repeating the above steps to cause the structure to shake relative to the member wherein the cavity is connected to the conduit by a branch conduit. The step of allowing the water hammer pressure pulse to propagate into the fluid filled cavity comprises allowing the water hammer pulse to propagate through the branch conduit into the cavity. The step of holding the valve open until the fluid flows through the conduit creates a velocity sufficient to create a water hammer within the conduit comprises reducing the fluid pressure in the cavity by allowing the fluid to flow through an aspirator in the conduit wherein the aspirator is connected to the branch conduit.

U.S. Pat. No. 5,508,975; to Walter, Bruno H.; and assigned to Industrial Sound Technologies, Inc., describes a liquid degassing apparatus and driving system comprising means for causing a first liquid to flow through a first conduit from an upstream end to a downstream end and a valve in the first conduit for selectively substantially blocking the flow of the first liquid. The valve has an open position wherein the flow is substantially unimpeded and a closed position wherein the flow is at least substantially blocked. There is an actuator for repeatedly opening the valve, keeping the valve open for a period sufficient to allow the first liquid to commence flowing, through the first conduit and the valve, with sufficient velocity to produce a water hammer within the first conduit when the valve closes. Closing the valve produces a continuous series of water hammer acoustic pulses within the first conduit. There is a chamber containing a second liquid coupled to the hydraulic driving system and a coupler in fluid communication with the driving system and the chamber with the coupler comprising a fluid-filled passage having a first end connected to the first conduit upstream from the valve and a second end connected to an interior region of the chamber and a stiff, resiliently deformable, impermeable, deflection cap blocking the fluid-filled passage.

U.S. Pat. No. 5,190,114; to Walter, Bruno H.; and assigned to Intech International, Inc., describes a liquid flow pulsing apparatus including a housing having means providing a passage for a flow of liquid and means for periodically restricting the flow through the passage to create pulsations in the flow and a cyclical water-hammer effect to vibrate the housing during use. The means for periodically restricting the flow including a constriction means in the passage to accelerate the flow to a higher velocity and a first passage region through which the accelerated higher velocity liquid flows followed by a downstream passage region adapted to provide for a reduced liquid velocity and a movably mounted control means exposed in use to the liquid pressures associated with the first passage region and to the liquid pressures associated with the downstream passage region. It is adapted to move between a first generally full-flow position and a second flow restricting position in the first passage region by virtue of alternating differential liquid pressure forces associated with said first passage region and the downstream passage region and acting on the control means during use. The housing is arranged such that the movably mounted control means has one surface portion exposed to the liquid flow in the first passage region and a generally opposing surface position in communication with the liquid pressure existing in the downstream passage region such that the control means tends to be moved rapidly in a cyclical fashion between the first and second positions by virtue of the alternating differential pressure forces which arise from liquid flow induced pressure effects and water hammer effects acting on the control means during use.

U.S. Pat. No. 5,009,272; to Walter, Bruno H.; and assigned to Intech International, Inc., describes a flow pulsing apparatus including a housing having means providing a passage for a flow of fluid and means for periodically interrupting the flow through the passage to create a cyclical water-hammer effect to vibrate the housing and provide pulsations in the flow during use. The means for periodically interrupting the flow include a constriction means in the passage to accelerate the flow to a higher velocity and a first passage region through which the accelerated higher velocity fluid flows followed by an enlarged downstream passage region adapted to provide for a reduced fluid velocity and a control means having a pair of generally opposed faces. The control means is associated with the first passage region and being movable between a substantially open full-flow position and a substantially closed flow interrupting position. The control means, in use, has one of the faces at least partially exposed to the higher velocity fluid flow provided by the first passage region such that when the control means is in the open position the higher velocity fluid flow tends to reduce the pressure force acting on at least a portion of the one face and when the control means is in the closed position the flow interruption creates a fluid pressure force increase acting on at least a portion of the one face while the other of the faces of the control means is, in use, at least partially exposed to the fluid pressures existing in the downstream passage region. The control means thus tends to be moved rapidly, or to vibrate, between the substantially open and substantially closed positions under the influence of the alternating differential pressure forces acting on the opposed faces of the control means during use.

U.S. Patent Publication No. US20060076163A1; to Terracina, et. al.; and assigned to Smith International, Inc., describes a method for designing a drill bit comprising modeling a domain between a drill bit having a first design and a surrounding wellbore, defining a plurality of regions wherein one of the plurality of regions is disposed within each of a plurality of flow paths through which fluid travels through the domain, determining an allocation of flow among the plurality of flow paths through the domain and modifying the first design of the drill bit such that the allocation of flow is substantially uniform among the plurality of flow paths.

U.S. Patent Publication No. US20050121235A1; to Larsen, et. al.; and assigned to Smith International, Inc., describes a drill bit comprising a bit body with a bit central axis and defining a gage diameter. A first roller cone, attached to the bit body, has a cone shell, a journal axis, a gage curve, a first set of cutting elements that cut to the gage diameter and a second set of cutting elements that cut inside the gage diameter. There is a gage point at the intersection of the gage curve and at least one of the first set of cutting elements. There is at least a second roller cone attached to the bit body, having a cone shell, a journal axis, a third set of cutting elements that cut to the gage diameter and a forth set of cutting elements that cut inside of the gage diameter. A first nozzle receptacle formed by the bit body and closer to the gage diameter than to the central axis with the first nozzle receptacle forming a first centroid and a first projected fluid path. The lateral angle for the first projected fluid path defined with respect to a first plane, the first plane being defined by the bit body central axis, and by a first line lying parallel to the bit body central axis and intersecting the first centroid. The first projected fluid path is disposed at an angle of at most a magnitude of six degrees to the first plane and a second nozzle receptacle formed by the bit body and closer to the gage diameter than to the central axis. The second nozzle receptacle forms a second centroid and a second projected fluid path. A lateral angle for the second projected fluid path is defined with respect to a second plane and also being defined by the bit body central axis. A second line lying parallel to the bit body central axis and intersecting the second centroid defines the second projected fluid path and is disposed at an angle of at least a magnitude of six degrees to the second plane wherein a radial angle for the second projected fluid path is defined with respect to at least two bounding lines. The second projected fluid path is directed between an outer gage boundary line and an inside boundary line with the outer gage boundary line being defined in a viewing plane perpendicular to the second projected fluid path. The outer gage boundary line is perpendicular to the projection of the journal axis for the first roller cone on the viewing plane and intersects the projected journal axis at a point of projection of an outer gage point on the viewing plane. The outer gage point is disposed at the intersection of the journal axis and a line perpendicular to the journal axis extending through the gage point.

An inside boundary line is defined in the viewing plane where the inside boundary line is perpendicular to the projected journal axis and intersects the projected journal axis at a projection of the inside bounding point on the viewing plane. The inside bounding point is disposed along the journal axis at a distance equal to 20 percent of the gage diameter from the outer gage point toward the bit body central axis.

U.S. Patent Publication No. US20040108138A1; to Cooper, et. al.; and unassigned, describes a method for optimizing drilling fluid hydraulics when drilling a well bore when the drilling fluid supplied by a surface pump through a drill string to a drill bit comprises the step of adjusting the flow rate of a surface pump and a fluid pressure drop across the drill bit while drilling such that the drill bit drilling fluid hydraulics are optimized for a given drilling condition.

U.S. Patent Publication No. US20030196836A1; to Larsen, et. al.; and unassigned, describes a roller cone drill bit comprising a drill bit body defining a bit diameter, a longitudinal axis, and an internal fluid plenum for allowing fluid to pass through and having at least a first cone. Additionally a nozzle retention body for attaching to the drill bit body adjacent the first cone wherein the nozzle retention body has an interior channel that is in fluid communication with the internal fluid plenum and with a fluid outlet means for fluid discharge from the interior channel. The fluid is directed along a centerline and the first cone includes at least one cutting element with a cutting tip with the shortest distance between the cutting tip and the centerline being less than 3% of the bit diameter.

The device provided by the current disclosure invention allows for the use of a flow throttling device (FTD) that moves from an initial position to an intermediate and final position in both the upward and downward direction corresponding to the direction of the fluid flow. The present invention avoids the direct use of springs, the use of which are described in the following patents which are also herewith incorporated by reference in U.S. Pat. No. 3,958,217, U.S. Pat. No. 4,901,290, and U.S. Pat. No. 5,040,155, and U.S. Pat. Nos. 6,588,518, 6,508,317, 6,279,670, and 6,053,261.

OBJECTIVES OF THE DISCLOSURE

An objective of the disclosure is an apparatus, method and system for generating pressure pulses flowing within a drill string having a pulse generating device longitudinally and axially positioned within an annular drill collar flow channel in a region above or below the drill the positive displacement motor, or the rotary steerable tool, or situated near the formation of interest that needs injection for tertiary recovery, or is situated adjacent to a formation that is being fractured. A pulsing/fracturing/drilling (PFD) medium (liquid or gas) flows through the annular drill collar flow channel (upper, middle, lower, and outer) and the PFD medium is guided into two sets of selectively reversible flow, pilot and lower flow connecting channels, wherein the connecting channels are connected to the guide pole channel and the annular drill collar flow channel. The annular drill collar flow channel is acted upon by one or more flow throttling devices (FTD's) thereby transmitting signals i.e. large, high frequency pressure pulses, wherein the apparatus utilizes a turbine residing near and within proximity of a flow diverter that diverts the PFD medium in the annular drill collar flow channel into and away from the turbine blades such that the force of the PFD medium causes the turbine blades and the turbine to rotationally spin around a coil assembly to generate electricity to operate and control the FTD.

Another objective of the disclosure is where the apparatus for generating pulses includes a pilot actuator assembly including, a pilot, a pilot shaft, a double rolling bellows, a flow throttling device (FTD), a bellows chamber, and a pulser guide pole. Pilot and lower inner flow connecting channels provide for reversal of flow wherein the pilot seals a middle annular drill collar flow channel from the lower annular drill collar flow channel such that the flow throttling device (FTD) and the pilot are capable of bi-directional axial movement along or within the pulser guide pole.

Another objective of the disclosure is where the coil assembly generates electrical power for operating a motor and other operating equipment useful for instrumentation with the motor having a drive shaft centrally located between the motor and a magnetic pressure coupling wherein the motor and the coupling are mechanically coupled such that the motor rotates a magnetic pressure coupling outer magnets and moves the pilot actuator assembly.

An additional objective of the disclosure is where the magnetic coupling is formed by a location external and internal to the magnetic pressure cup where outer magnets are placed in relation to inner magnets. The inner magnets are located in a position inside the magnetic pressure cup. Coupling of the inner and outer magnets allow for translating rotational motion of the motor and outer magnets to linear motion of the inner magnets via a magnetic polar interaction wherein linear motion of the inner magnets move the pilot actuator assembly. The linear movement of the pilot into a pilot seat closes a pilot seat orifice lifting a flow throttling device (FTD) into a flow throttling orifice and thereby generating a pulse. Further rotation of the motor drive shaft and outer magnets move the pilot actuator assembly and the pilot away from the pilot seat causing the flow throttling device (FTD) to move away from the flow throttling orifice thereby ending the positive pulse.

Another objective of the disclosure is the motor is connected to a drive shaft through a mechanical device including a worm gear, or other mechanical means for converting the rotational motion of the motor into linear motion to propel the pilot actuator assembly.

Another objective of the disclosure includes a pulser guide pole capable of providing a path for the pilot and the flow throttling device (FTD) for operation in a bi-directional axial movement.

Another objective of the disclosure is where the pilot actuator assembly is comprised of a rear pilot shaft, front pilot shaft, and pilot.

In another objective the differential pressure is minimal in that slight force acting on a small cross-sectional area of a pilot seat defines a pressure that is required to either engage or disengage the pilot.

Another objective of the disclosure the motor is synchronous, asynchronous, or stepper and is activated to fully rotate or to rotate incrementally in various degrees depending on wellbore conditions, the observed signal intensity, and/or duration of drilling.

Another objective is where the turbine resides within the annular drill collar flow channel of a flow guide and wherein the annular drill collar flow channel has diverting vanes that direct flow of PFD medium through and around a surface of the turbine.

In yet another objective of the disclosure the turbine includes a turbine shroud having turbine magnets that rotate with the motion of the turbine around the coil assembly causing electrical power to be generated and allowing for decreased battery requirements, a decrease in cost of the battery, decreased operational downtime, and subsequently decreased cost of the apparatus.

In another objective of the disclosure, energy consumption may also be further reduced by pre-filling a bellows chamber located within the double rolling bellows with a lubricating fluid, gel or paste.

Another objective of the disclosure is where the outside diameters of the turbine blades around a pulser housing is smaller than a flow guide extension inner diameter thereby allowing the turbine to be removed concurrently with the pulser housing.

In another objective of the disclosure, the apparatus for generating pulses includes allowing a double rolling bellows to move linearly, concurrent with the pilot actuator assembly. The design of the double rolling bellows interacts with the pilot actuator assembly and a bellows chamber allowing the double rolling bellows to conform to the space constraints of the bellows chamber providing flexible sealing without the double rolling bellows being displaced by the pressure differential created by the drilling fluid. The double rolling bellows may include a double loop configuration designed for flexible sealing thereby requiring less energy consumption during displacement of the double rolling bellows.

Another objective of the disclosure is where the pressure pulse in the PFD medium is sensed by instrumentation located uphole and wherein the pulse is communicated with wireless devices to a computer with a programmable controller for interpretation.

In another objective of the disclosure the pulse is used for isolating the fracturing the formation of interest with a packer isolation mechanism (PIM) and flow throttling device (FTD), either while or after drilling, thus reducing the number of frac pumps required uphole.

As another objective of the disclosure, the drill collar, which can act as a packer isolation mechanism (PIM) in cased hole applications, where the PFD medium flows into a flow guide into the upper annular drill collar flow channel and also into a pulser guide pole such that the PFD medium from the upper annular drill collar flow channel flows through outer annular drill collar flow channels when the flow throttling device (FTD) is in the open position and not in contact with a flow throttling device (FTD) seat.

Another objective of the disclosure is when the flow throttling device (FTD) is in the open position, the PFD medium flows unrestricted around the flow throttling device (FTD) bypass flow regulators and continues exiting the outer annular drill collar flow channels.

Another objective of the disclosure is where the linear movement of the flow throttling device (FTD) is caused by the PFD medium that is moving through the pulser guide pole, passing through the pulser guide pole and exiting into a flow throttling device (FTD) pressure chamber above a rotating valve which includes a featured rotating valve flow bevel that is coupled to a positive displacement motor.

Another objective of the disclosure is where the positive displacement motor provides rotational motion to the rotating valve such that the upper portion of the rotating valve resides at the bottom of the pulser guide pole and, upon rotation, allows the rotating valve flow bevel to seal and unseal the guide pole channel forcing the PFD medium to flow into the flow throttling device (FTD) pressure chamber, thereby hydraulically moving the flow throttling device (FTD) up the pulser guide pole until it contacts the flow throttling device (FTD) seat, thus closing off the outer annular drill collar flow channels.

Another objective of the disclosure is where the rotational motion of a rotating valve moves the rotating valve flow bevel past the guide pole channel sealing the guide pole channel and creating back pressure within the pulser guide pole, refilling the flow throttling device (FTD) pressure chamber.

Another objective discloses a high pressure relief spring such that should the positive displacement motor fail, the rotating valve is pulled away from the guide pole channel, allowing the PFD medium to evacuate the system.

In another objective of the disclosure, the PFD medium flows into the flow guide and into the annular drill collar flow channel and also into the guide pole channel within the pulser guide pole. The PFD medium from the annular drill collar flow channel flows through the outer annular drill collar flow channels when the flow throttling device (FTD) is in the open position and not in contact with the flow throttling device (FTD) seat such that when the flow throttling device (FTD) is in the open position the PFD medium flows unrestricted around the flow throttling device (FTD) bypassing the flow regulator. The PFD medium from a bypass flow regulator continues moving down the outer annular drill collar flow channels where the mud contacts the turbine blade causing the turbine blade to rotate the positive displacement turbine thus using the linear motion of the PFD medium to convert into rotational motion at the positive displacement turbine.

Another objective of the disclosure is that the positive displacement turbine rotates the rotating valve within the flow throttling device (FTD). The rotating valve includes a top angled cutout and a bottom angled cutout located at a topmost portion of the rotating valve within a lower end of the pulser guide pole such that the PFD medium in the pulser guide pole contacts the top angle cutout of the rotating valve.

Yet another objective of the disclosure an angle of a rotating top angled guide coincides with a chamber inlet channel within the pulser guide pole such that the PFD medium is allowed to enter the flow throttling device (FTD) pressure chamber allowing the PFD medium to exert a hydraulic pressure raising the flow throttling device (FTD) until the PFD medium contacts the flow throttling device (FTD) seat shutting off the flow of the PFD medium through the outer annular drill collar flow channels.

Another objective of the disclosure is where the movement of the flow throttling device (FTD) against and away from the flow throttling device (FTD) seat causes opening and closing the outer annular drill collar flow channels sending a pressure pulse through the PFD medium capable of measurement uphole by a pressure or sonic sensor or elsewhere in another borehole or various surface or subsurface locations.

Another objective of the disclosure is where a top angled cutout and bottom angled cutout are continuously rotated as part of the rotating valve any time within the PFD medium such that a rotational frequency of the top angled cutout and the bottom angled cutout by a chamber inlet channel and a chamber exhaust channel determines the pressure pulse duration and frequency.

Another objective of the disclosure is where the rotational speeds are generally slow and generate pressure pulses varying frequencies and amplitudes, depending on whether you are increasing the rate of drilling, sending information, propagating seismic waves, fracturing the formation, or providing pulses for the injection into a formation for tertiary recovery.

Additionally another objective is where the pulser guide pole allows for the chamber inlet channel and the chamber exhaust channel to be linearly offset so that the top angled cutout never aligns with the chamber exhaust channel and the bottom angled cutout never aligns with the chamber inlet channel.

Another objective of the disclosure is where the flow throttling device (FTD) includes within and attached to the flow throttling device (FTD) at least one outer magnet and inner magnets are attached to an inner magnet sleeve which moves axially along the pulser guide pole allowing the PFD medium to flow down the pulser guide pole when the flow throttling device (FTD) is in the open position and flows into the flow throttling device (FTD) pressure chamber creating a hydraulic pressure that moves the flow throttling device (FTD) upwards to ensure contact with the flow throttling device (FTD) seat thus closing off the outer annular drill collar flow channels.

Another objective of the disclosure is where the outer magnets attached to the flow throttling device (FTD) move with the flow throttling device (FTD) past the inner magnets causing a magnetic end field of the outer magnets to pass a magnetic end field of the inner magnets, wherein the inner magnet also includes a plurality of ports that align with the flow throttling device (FTD) pressure chamber and pilot exhaust channels.

Another objective of the disclosure is where the arrangement of the magnetic poles at the ends of the magnets and orientation of the magnets within the flow throttling device (FTD), wherein the passing of the outer magnets causes the inner magnets to switch from magnetic repulsion (of like poles) to magnetic attraction (of unlike poles) causing the inner magnets to move upward thereby sealing the guide pole channel from the flow throttling device (FTD) pressure chamber such that in this position the inner magnets open up the pilot exhaust channels such that pressure is relieved from the flow throttling device (FTD) pressure chamber and the flow throttling device (FTD) is pushed down the pulser guide pole.

Another objective of the disclosure is where the movement of the flow throttling device (FTD) and outer magnets downward allows the outer magnets to travel past the inner magnets, magnetically attracting the inner magnets and allowing for movement away from openings for the flow throttling device (FTD) pressure chamber such that the outer magnets move down to cover the pilot exhaust channels opening up the guide pole channel allowing for filling of the flow throttling device (FTD) pressure chambers.

Another objective of the disclosure is where the apparatus has a drill string adapter and with an outer casing with an upper pressure chamber and a lower pressure chamber such that the lower pressure chamber has one or more vent channels allowing for internal pressure to be equal to that of an annulus pressure.

Another objective of the disclosure includes a drill bit adapter shaped such that a piston land with a top land surface and a bottom land surface and land seal are all axially moveable and define a variable volume within the upper pressure chamber and lower pressure chamber.

Another objective of the disclosure is where the drill bit adapter also has a centrally located adapter channel through which drill mud flows to a drilling head.

Another objective of the disclosure is where the lower pressure chamber has an internal lower end spline through which an external drill bit adapter spline fits and an internal lower end spline and external drill bit adapter spline allowing for axial movement of the drill bit adapter and independent of the drill string adapter.

Yet another objective of the disclosure is where the intermeshing of the internal lower end spline and the external drill bit adapter spline interlock the drill string adapter and the drill bit adapter so that the adapters move as a unit rotationally.

Another objective of the disclosure is where the upper pressure chamber contains an upper spring functioning to provide a variable pressure on the top land surface of the piston land thereby transmitting that force through the piston land to the drill bit adapter, wherein an upper spring compensates for variations in movement of a drill bit and subsequently the drill bit adapter and wherein the lower pressure chamber includes a lower spring which resides below the piston land and the drill bit adapter and contacts the bottom land surface.

Another objective of the disclosure is where the lower spring and the upper spring act in opposing directions to each other on the piston land, bottom land surface and top land surface thereby dampening axial motion of the drill bit adapter.

Another optional objective of the disclosure is where a drill bit adapter vent is included wherein the adapter channel to the lower pressure chamber for a measurement while drilling (MWD)/pulser or PFD device exists such that the vent channel may be capped or blocked and wherein installation of an MWD/pulser or PFD device may be installed within the adapter channel.

Another objective of the disclosure is where the downhole drilling apparatus for mounting on a drill string, having a drill bit, exists and the apparatus has a MWD or PFD apparatus. A pressure responsive device operatively associated with the MWD or PFD apparatus and responsive to pressure pulses produced by the MWD or PFD apparatus creates an impulse force on a portion of the drill string, wherein the impulse force is utilized to provide a hammer drilling effect at the drill bit.

Another objective of the disclosure is where the pressure responsive device is in the form of a shock tool.

Another objective of the disclosure is where the shock tool forms part of the drill string and axially extends and retracts in response to changes in internal fluid pressure.

Another objective of the disclosure is where the shock tool is tubular and comprises of two telescoping parts with a spring located there between.

Another objective of the disclosure is where the one of the parts defines a piston, such that a rise in PFD medium pressure within the tool tends to separate the parts and thus axially extend the tool.

Another objective of the disclosure is where the pressure responsive device is located above the MWD or PFD apparatus.

Another objective of the disclosure is where the pressure responsive device is located below the MWD or PFD apparatus.

An additional objective of the disclosure is where two or more apparatuses for generating pressure pulses in a PFD medium are combined, flowing within a drill string having a pulse generating device longitudinally and axially positioned within an annular drill collar flow channel such that the PFD medium flows through the annular drill collar flow channel and the PFD medium is guided into two sets of selectively reversible flow, pilot and lower flow connecting channels, wherein the connecting channels are connected to an guide pole channel and the annular drill collar flow channel, and wherein the annular drill collar flow channel is acted upon by one or more flow throttling devices thereby transmitting signals, wherein the device utilizes a turbine residing near and within proximity of a flow diverter that diverts the PFD medium in the annular drill collar flow channel into and away from turbine blades such that the force of the PFD medium causes the turbine blades and the turbine to rotationally spin around a coil assembly.

An additional objective in the disclosure is to claim this method in which pressure pulses apply an additional force to the bit and then releasing this force, thus pulling the drill bit away from the cutting surface and allowing the stored energy in the fluid column to clean the bit and cuttings away as the bit withdraws from the cutting surface.

SUMMARY

One device involves the placement of a Pulsing-Fracturing-Drilling (PFD) pulser device including a flow throttling device (FTD) located within a drill collar in a wellbore or other contained column of PFD medium incorporating PFD medium above or below the drill bit and/or the positive displacement motor or rotary steerable tool (when in a wellbore).

The present disclosure will now be described in greater detail and with reference to the accompanying drawings.

With reference now to FIG. 1, the device illustrated produces pressure pulses in PFD medium flowing through a tubular drill collar or PIM and an upper annular drill collar flow channel. The flow guide is secured to the inner diameter of the drill collar/PIM. The centralizer secures the lower portion of the pulse generating device and is comprised of a non-magnetic, rigid, wear resistant material with outer flow channels.

Specifically, the pulser assembly provides essentially four outer flow channels that allow fluid or gas, such as drilling mud, or PFD medium to flow. These are defined as the upper annular, the middle annular, lower annular, and centralizer annular collar flow channels. The inner lower and inner middle flow channels direct the PFD medium flow to the pulser assembly within the PFD device. Annular flow of the PFD medium, by the flow guide and flow throttling device (FTD), is essentially laminar, and pulse signals are generated that are more detectable. Incorporation of a method and system of magnetic coupling, a concentrically located turbine, inductive coil for electrical power generation, double rolling bellows design and reduced pressure differential, collectively significantly reduce battery energy consumption when compared with conventional PFD devices.

In a preferred embodiment, the PFD device utilizes a turbine residing near and within the proximity of a flow diverter. The flow diverter diverts PFD medium in an annular drill collar flow channel into and away from the turbine blades such that the force of the PFD medium causes the turbine blades and turbine to rotationally spin around an induction coil. The induction coil generates electrical power for operating the motor and other instrumentation mentioned previously. The motor is connected to the pilot actuator assembly via a drive shaft. The pilot actuator assembly comprises a magnetic coupling and pilot assembly. The magnetic coupling comprises outer magnets placed in direct relation to inner magnets located within the magnetic pressure cup or magnetic coupling bulkhead. The magnetic coupling translates the rotational motion of the motor, via the outer magnets to linear motion of the inner magnets via magnetic polar interaction. The linear motion of the inner magnets moves the pilot assembly, comprising the pilot shaft, and pilot valve, linearly moving the pilot into the pilot seat. This action allows for closing the pilot seat, pressurizing the flow throttling device (FTD), closing the flow throttling device (FTD) orifice, thereby generating a pressure pulse. Further rotation of the motor and drive shaft, via the magnetic coupling, moves the pilot assembly and pilot away from the pilot seat, depressurizing the flow throttling device (FTD) pressure chamber and opening the flow throttling device (FTD) and completing the pressure pulse.

Identical operation of the pilot into and out of the pilot seat orifice can also be accomplished via linear to linear and also rotation to rotation motions of the outer magnets in relation to the inner magnets such that, for example, rotating the outer magnet to rotate the inner magnet to rotate a (rotating) pilot valve causing changes in the pilot pressure, thereby pushing the FTD (flow throttling device) up or down.

Unique features of the pulser include the combination of middle and lower annular drill collar flow channels, flow throttling device (FTD), double rolling bellows, and pilot and lower flow connecting channels possessing angled outlet openings that helps create signals during transitioning from both the sealed (closed) and unsealed (open) positions. Additional unique features include a flow guide for transitional flow and a flow throttling device (FTD) pressure chamber designed to allow for generation of the pressure pulses. The flow throttling device (FTD) slides axially on a pulser guide pole being pushed by the pressure generated in the flow throttling device (FTD) pressure chamber when the pilot is in the seated position. Increased bit rate is generated by allowing the PFD medium to quickly back flow through the unique connecting channel openings when the pilot is in the open position. Bi-directional axial movement of the poppet assembly is generated by rotating the motor causing magnets to convert the rotational motion to linear motion which opens and closes the pilot valve. It should be noted that rotary-rotary, rotary-linear, and linear-linear interaction of magnets with the poppet valve of the flow throttling device (FTD) are all acceptable and possible modes of moving the pulser in a bi-directional manner.

Pulses of identical magnitude and frequency may be transmitted because the pulse is developed in near-laminar flow within the uniquely designed flow channels and a repeatable water hammer effect occurs due to the small amount of time required to close the flow throttling device (FTD).

The method for generating pressure pulses in a PFD medium flowing downward within a drill string or PIM in a region above or below the drill bit/PIM and/or the positive displacement motor or rotary steerable tool includes starting at an initial first position wherein a pilot (that can seat within a pilot seat which resides at the bottom of the middle annular drill collar flow channel) within a lower annular drill collar flow channel is not initially engaged with the pilot seat. The pilot is held in this position with the magnetic coupling. The next step involves rotating the motor causing the magnetic fields of the outer and inner magnets to move the pilot actuator assembly thereby moving the pilot into an engaged position with the pilot seat. This motion seals a lower annular drill collar flow channel from the middle annular drill collar flow channel and forces the inner PFD medium into a pair of upper connecting flow channels, expanding the flow throttling device (FTD) pressure chamber, causing a flow throttling device (FTD) to move up toward a middle annular drill collar flow channel and stopping before the orifice seat, thereby causing a flow restriction. The flow restriction causes a pressure pulse or pressure increase transmitted uphole. At the same time, PFD medium remains in the exterior of the lower connecting flow channels, thus reducing the pressure drop across the pilot seat. This allows for minimal force requirements for holding the pilot in the closed position. In the final position, the pilot moves back to the original or first position away from the pilot orifice while allowing fluid to flow through the second set of lower connecting flow channels within the lower annular drill collar flow channel. This results in evacuating the flow throttling device (FTD) pressure chamber as PFD medium flows out of the chamber and back down the pilot connecting channels into the middle annular drill collar flow channel and eventually into the lower annular drill collar flow channel. As this occurs, the flow throttling device (FTD) moves in a downward direction along the same direction as the flowing PFD medium until it is motionless. This decreases the FTD created pressure restriction of the main PFD medium flow past the flow throttling device (FTD) orifice completing the pulse. Controlling the pulse near the drill bit is essential to the operation of the present device. By developing and/or controlling the pulse, it is possible to prevent, avoid, or eliminate "stick-slip" in many deviated or horizontal wells and placement of this amplification pulser with regard to the positive displacement motor or other similar device will likely determine the success rate of employing the PFD. Optimizing the pressure pulses' amplitudes and frequencies will also enhance the ROP (rate of penetration) in vertical sections along with increase the directional accuracy and aid in drilling a more vertical well, of so desired. It will also allow for an increased horizontal and vertical depth due to the increased ROP and ability to remove cutting and apply WOB (weight on the bit) in the deeper wells due to its snake-like action.

An alternative embodiment for this PFD assembly unit includes connecting the motor to a drive shaft through a mechanical device such as a worm gear, barrel cam face cam or other mechanical means for converting the rotational motion of the motor into linear motion to propel the pilot actuator assembly. An electronic circuit package can be used to control the motion and frequency of opening and closing the flow throttling device (FTD).

Yet another embodiment of the this PFD assembly unit includes a device which includes a pulser housing or bell with ports or channels through the housing or bell itself to allow for pilot flow exhaust adding another feature which assists in ensuring that pulsing continues if other flow channels become clogged during operation.

In a separate apparatus design, the use of hydraulics together with an anti-magnetic polar interaction is used to drive the flow throttling device (FTD) such that magnets are located both within an extended and elongated pulser bell housing and as part of the magnet coupling assembly that is initially located below the flow throttling device (FTD). Using the magnets in this arrangement, before there is any flow, the anti-magnetic forces (caused by N-S pole alignments) push the pulser bell/flow throttling device (FTD) assembly toward either an opened or closed position. In other words, the magnetic forces are always pushing against each other which allows for more regulated movement of the bell and FTD and helps ensure that there is little or no "sticking" of the position of the bell or poppet in the "dead center" position.

In yet another apparatus design, a rotational poppet is utilized, similar or identical to that used with the prior inventors' MWD tool. This poppet activates the flow throttling device (FTD) so that pulses are created. The flow is diverted directly to the turbine which rotates the turbine blades (similar in design to the MWD turbine blades) at different or variable speeds depending on channel dimensions as well as the design of the turbine blades themselves. It has been determined that blades with small degree angles may turn slowly enough so that control of the motion of FTD is possible without the use of gears. For example, a high torque provided by the flow to the turbine could lead to a low spin speed of the blade, thereby allowing the operator freedom to choose pulse frequency and amplitude/magnitude. Pulse amplitude and rate is vitally important to drilling straight holes, drilling speeds, drilling lengths or fracturing of the formation(s). Additionally, separate flow channels can be used as a failsafe mechanism to allow flow to by-pass the FTD.

In a further apparatus design, a more conventional telescoping hammer "sub" drill arrangement can be employed in that the flow throttling device (FTD) and remainder of the PFD described in the first apparatus above is located in special location with the drill collar. The location allows for telescoping of the collar, such that the collar provides a pistoning effect as pulsing occurs. Specifically, when the bell portion of the FTD closes, it is desirable to "hammer" the drill bit more than what would normally occur in the presence of PFD medium or drilling mud. As the bell portion of the FTD closes, the pressure above the drill collar increases. This increased pressure expands the hammer "sub" drill arrangement. As the bell portion of the FTD closes, this relieves the pressure build-up, and the weight of the entire drill string will be directed in the downward direction combined with the force of gravity. The movement should allow for the hammering effect that enhances the working of the drill bit, thereby increasing drill rate and overall drilling effectiveness. When the FTD opens, the extra weight on the bit is released and the drill string jerks back uphole, allowing the stored pressure within the fluid column to release through the jets, thus cleaning the bit, reducing stick slip, and cleaning the densest cuttings sitting in the bottom of the hole.

The incorporation of a gamma ray sensor together with any of the aforementioned designs will enhance the ability to keep the drilling rig and bit within the "payzone" for extended times. In addition, the use of these designs with or without a drill bit can be extended to determining more information regarding the oil/gas formation by measuring the magnitude of the pulses at distances remote from the downhole bore location. Sensors which may be placed at different locations away from the drilling site i.e. in nearby boreholes or several locations on the surface could be used to triangulate the exact location of the drill bit based on transit times in formations, indicate formation types due to pulse magnitude and propagation dampening, location of fractures in real time relative to the bit for directing while drilling, travel distance and velocities as required by the operation.

DETAILED DESCRIPTION

The present invention will now be described in greater detail and with reference to the accompanying drawings. With reference now to FIG. 1, the device illustrated produces pressure pulses in drilling fluid flowing through a tubular drill collar and upper annular drill collar flow channel. The flow guide is secured to the inner diameter of the drill collar/PIM. The centralizer secures the lower portion of the pulse generating device and is comprised of a non-magnetic, rigid, wear resistant material with outer flow channels.

In the open position the pilot is not engaged within the pilot seat allowing flow through the pilot seat. In the open position, fluid flows past the fishing head through the mud screen where a portion of the fluid flows through the pilot assembly. Fluid within the fishing head assembly flows through the upper orifice between the fishing head inner screen and the guide pole channel to allow for flow within the guide pole channel in the center of the pulser guide pole.

In the closed position the pilot actuator assembly moves the pilot until it is in closed position with the pilot seat where no flow through can occur. The pilot actuator assembly is the only portion of the shaft that moves the pilot in a translational or rotational direction. The pilot orifice and pilot seat must be related to ensure hydraulic pressure differential which allows proper movement of the flow throttling device (FTD).

The lower annular drill collar flow channel and the lower flow connecting channels are effectively sealed from the pilot channel so that their fluid flow is completely restricted from the interior of the FTD. As this sealing is achieved, fluid still enters the guide pole channel via the connecting channel, thus almost equalizing the pressure across the pilot assembly. The downward flow through the drill collar causes the fluid to flow past the fishing head and mud screen assembly. Fluid then flows into the middle guide pole channel through the pilot connecting channels and into the flow throttling device (FTD) pressure chamber filling and expanding the flow throttling device (FTD) pressure chamber, causing the flow throttling device (FTD) to rise along the pulser guide pole. This effectively restricts the middle annular drill collar flow channel from the lower annular drill collar flow channel, thereby generating a positive signal pulse at the throttle zone for pulse generation and corresponding signal transmittal.

These conditions provide generation of pulses as the flow throttling device (FTD) reaches both the closed and opened positions. The present invention allows for several sized FTD's (FIGS. 2A-D) to be placed in a drilling collar, thereby allowing for different flow restrictions and/or frequencies which will cause an exponential increase in the data rate that can be transmitted up hole.

Positioning of the pulser assembly within the drill collar and utilizing the flow guide significantly decreases the turbulence of the fluid. The linear motion of the flow throttling device (FTD) axially along the pulser guide pole is both up and down (along a bi-axial direction).

Conventional pulsers require adjustments to provide a consistent pulse at different pressures and flow rates. The signal provided in conventional technology is by a pulse that can be received up hole by use of a pressure transducer that is able to differentiate pressure pulses (generated downhole). These uphole pulses are then converted into useful signals providing information for the oilfield operator, such as gamma ray counts per second, azimuth, etc. Another advantage of the present disclosure is the ability to create a clean (essentially free of noise) pulse signal that is essentially independent of the fluid flow rate or pressure within the drill collar. The present invention thereby allows for pulses of varying amplitudes (in pressure) and frequencies to increase the bit rate. Addition of more than one pulser assemblies would lead to an exponential increase in the data bit rate received uphole.

The connecting flow channels allow for equalization of the pressure drop across the pilot to be matched by the flow throttling device (FTD) as a servo-amplifier. The primary pressure change occurs between the inner middle and inner lower flow channels providing a pressure drop created by the flow throttling device (FTD) restricting the annular flow through the throttle zone. The pressure drop across the pilot is the only force per unit area that must be overcome to engage or disengage the pilot from the seated position and effect a pulse. This pressure drop across a minimal cross-sectional area of the pilot ensures that only a small force is required to provide a pulse in the larger flow area of the FTD.

While the present invention has been described herein with reference to a specific exemplary embodiment thereof, it will be evident that various modifications and changes may be made thereto without departing from the broader spirit and scope of the invention as set forth in the appended claims. The specification and drawings included herein are, accordingly to be regarded in an illustrative rather than in a restrictive sense.

Magnetic coupling alleviates the concern for a rotary seal or bellow type seal which other MWD tools possess and it is noted that such seals have caused flooding and maintenance issues.

DETAILED DESCRIPTION OF THE DRAWINGS

The detailed description refers to the placement of a Measurement-While-Drilling (MWD) device [100] located within a drill collar [29] in a well bore incorporating fluid generally known as drilling mud [115]. Descriptions of the present disclosure are incorporated within the aforementioned detailed description. The MWD device [100] is described in greater detail referring specifically to the accompanying figures.

Figure 1:
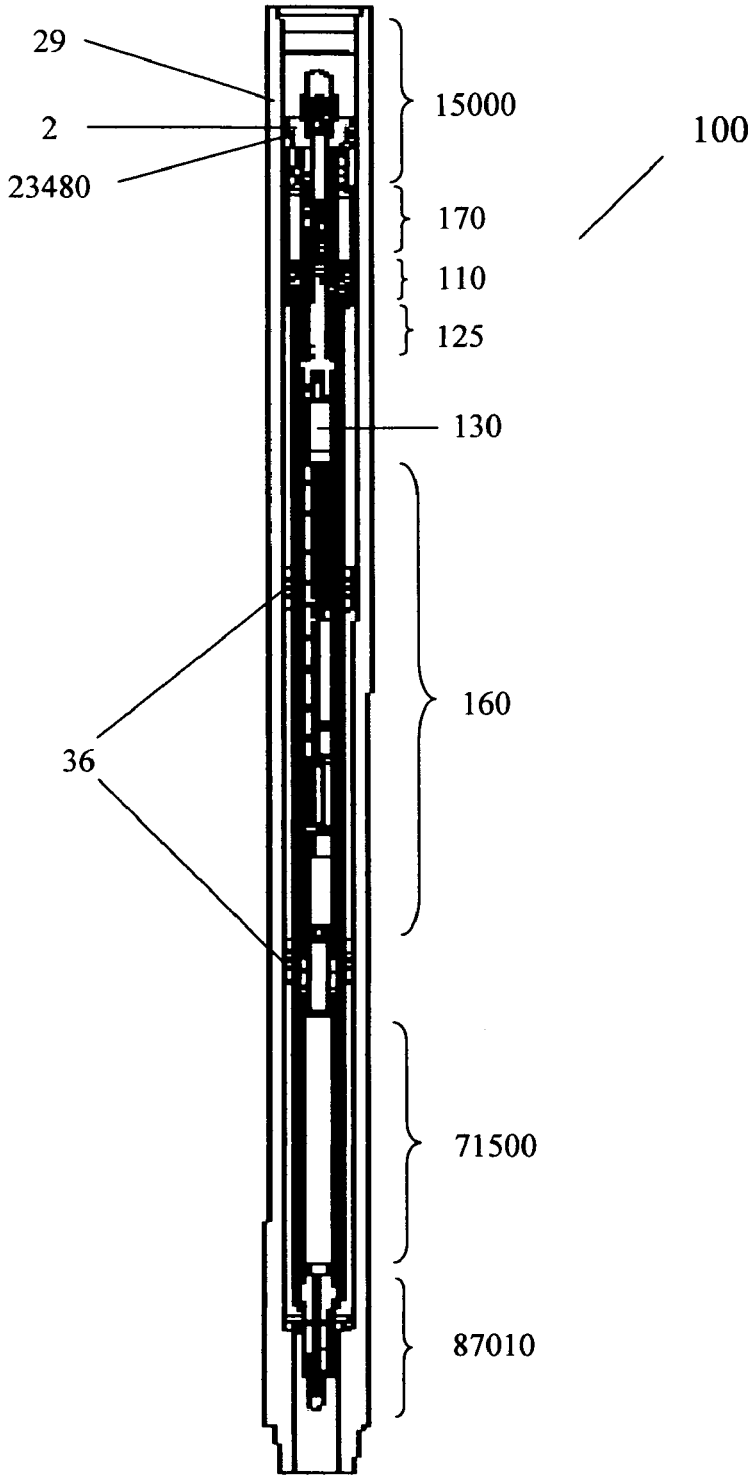
FIG. 1 is an overview of an MWD

With reference now to FIG. 1, the device illustrated produces pressure pulses in drilling fluid flowing through a tubular drill collar [29] and an upper annular drill collar flow channel [2]. The flow guide [23480] is secured to the inner diameter of the drill collar [29]. The centralizer [36] secures the lower portion of the MWD device [100] and is comprised of a non-magnetic, rigid, wear resistant material with outer flow channels. Major assemblies of the MWD device [100] are shown as the fishing head assembly [15000], flow throttling device (FTD) and pulser actuator assembly complete the pulser assembly [170], turbine [110] and coil assembly [125], motor [130], various instrumentation [160], battery [71500], and stinger [87010].

Figure 2A:
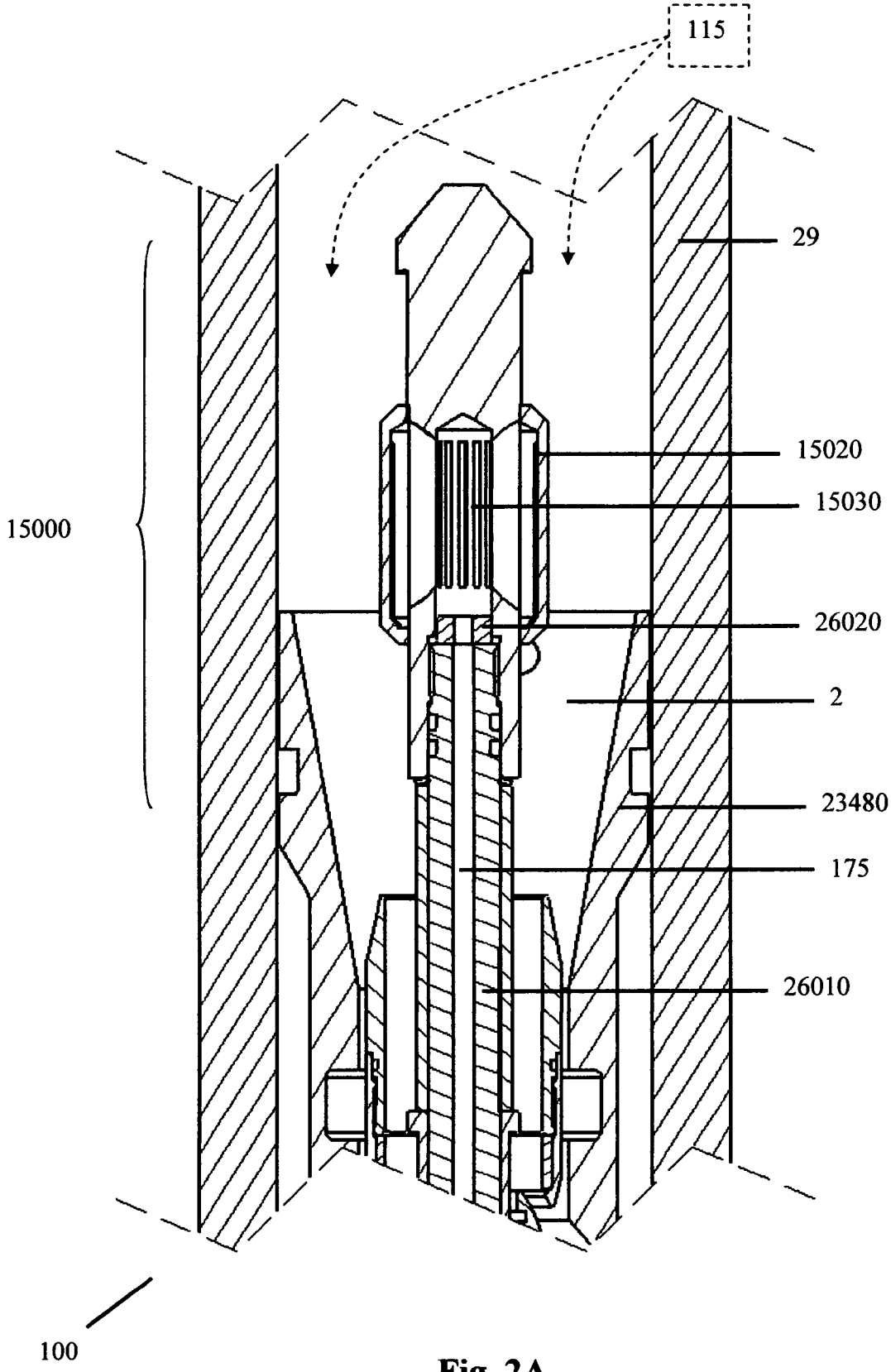
FIG. 2A is a cut-away longitudinal sectional view of the fishing head assembly.

FIG. 2A details the open position; drilling mud [115] flows past the fishing head assembly [15000] and fishing head outer screen [15020] where a portion of the drilling mud [115] flows through the fishing head inner screen [15030]. Drilling mud [115] within the fishing head assembly [15000] flows through the upper orifice [26020] between the fishing head inner screen [15030] and the guide pole channel [175] to allow for flow within the guide pole channel [175] in the center of the pulser guide pole [26010].

These conditions provide generation of a pulse as the flow throttling device (FTD) reaches both the closed and opened positions. The present invention allows for several sized flow throttling devices (FIG. 1) to be placed in a drilling collar, thereby allowing for various pressure pulse amplitudes and/or frequencies and consequential exponential increases in the data rate.

Figure 2B:
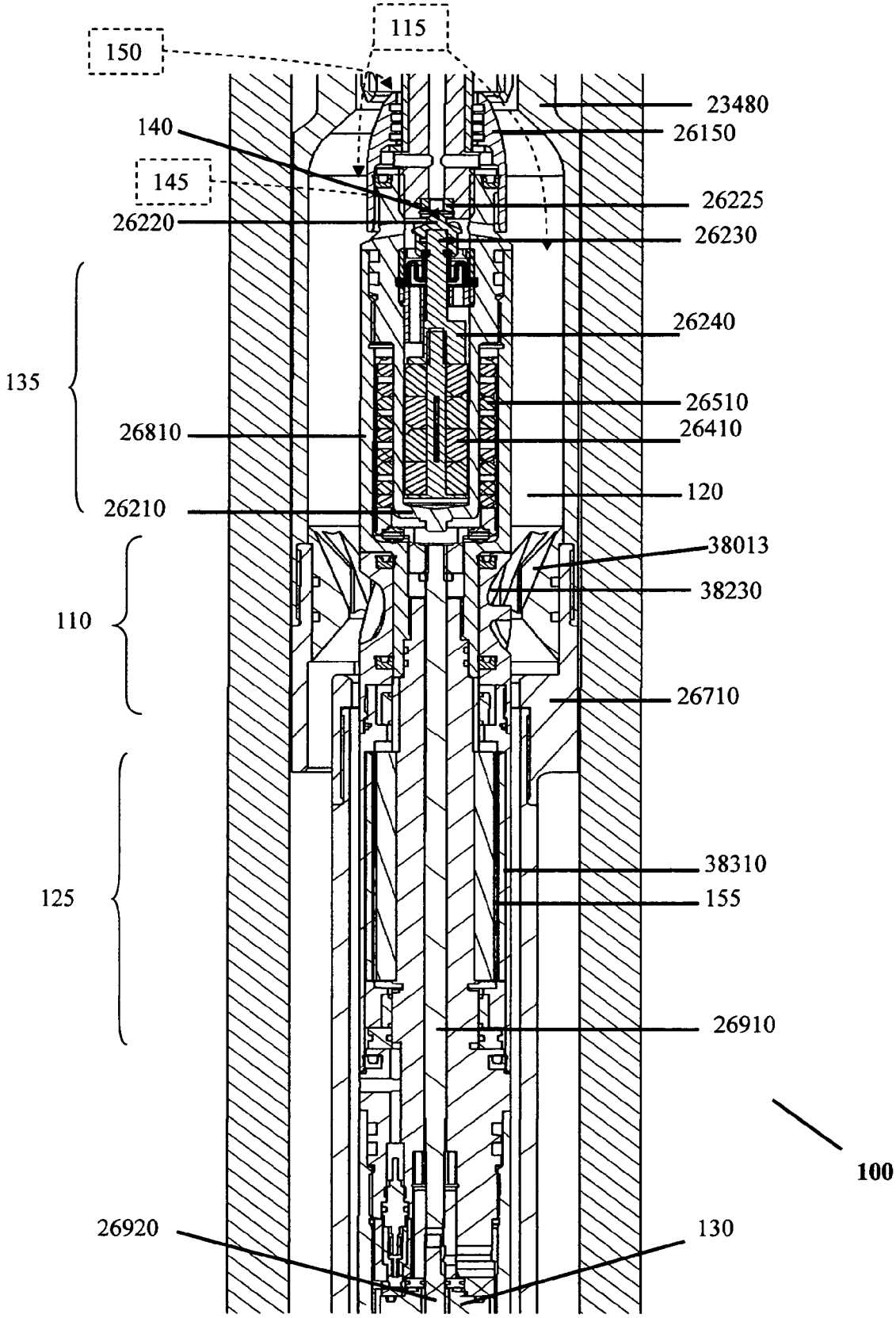
FIG. 2B is a continuation of the cross-sectional view shown in FIG. 2A and includes details of the pulser, turbine, coil and motor assemblies.

In a further embodiment, FIG. 2B describes the MWD device [100] which utilizes a turbine [100] residing near and within proximity of a flow diverter [38013]. The flow diverter [38013] diverts drilling mud [115] in an lower annular drill collar flow channel [120] into and away from the turbine blade [38230] such that the force of the drilling mud [115] causes the turbine blade [38230] and turbine assembly [110] to rotationally spin around a coil assembly [125]. The coil assembly [125] generates electrical power for operating the motor [130] and various instrumentation [160] (FIG. 1). The motor [130] comprises a worm gear [26920] or transmission system with fixed or adjustable gear ratios, a drive shaft [26910] centrally located between the motor [130] and the outer magnets [26510] and mechanically coupled to both. Located in a position external to the magnetic pressure cup [26210] are outer magnets [26510] placed in relation to inner magnets [26410] located in a position inside the magnetic pressure cup [26210] forming a magnetic coupling. The coupling is for translating the rotational motion of the motor [130], and outer magnets [26510] to linear motion for the inner magnets [26410] via a magnetic polar interaction. The linear motion of the inner magnets [26410] help move the pilot actuator assembly [135], comprised of the rear pilot shaft [26240], front pilot shaft [26230] and pilot [26220], linearly moving the pilot [26220] into the pilot seat [140] closing the pilot seat orifice [145] lifting the flow throttling device (FTD) [26150] into the flow throttling device (FTD) orifice [150] thereby generating a pressure pulse. A pilot valve [26225] is comprised of the pilot [26220], the pilot seat [140] and the pilot seat orifice [145]. Further rotation of the motor [130], drive shaft [26910] and outer magnets [26510] move the pilot actuator assembly [135] and pilot [26220] away from the pilot seat [140] causing the flow throttling device (FTD) [26150] to move away from the flow throttling device (FTD) orifice [150] thereby generating a negative pressure pulse. The inner magnets [26410] are isolated from the drilling mud [115] via a double rolling bellows [26310] which is described further in FIGS. 4 and 5. A pulse in the drilling mud [115] is sensed by the uphole system comprised of a pressure transducer and/or other sound wave receivers and communicated, optionally with wireless devices, to a computer [165](not shown) for interpretation and data reception and storage.

Additionally, further description of FIG. 2B shows the turbine [110] which resides within the lower annular drill collar flow channel [120] of the flow guide [23480]. The lower annular drill collar flow channel [120] may have special flow diverters [38013] that direct the flow of the drilling mud [115] through and around the surface of the turbine [110]. The flow diverters [38013] project from the flow guide extension [26710] in a fashion so as to direct the flow of the drilling mud [115] to move the turbine blade [38230] and attached turbine assembly [110] thereby changing the linear motion of the drilling mud [115] into rotational motion of the turbine assembly [110]. The turbine shroud [38310] contains magnets [155] that rotate with the motion of the turbine [110] around a coil assembly [125] causing electrical power to be generated for the operation of the motor [130]. The outside diameter of the turbine blade [38230] is smaller than the flow guide extension [26710] inner diameter, thereby allowing the turbine [110] to be removed concurrently with the pulser housing [26810] from the MWD device [100]. The configuration of the turbine blade [38230] and flow diverter [38013] may be of various angles depending on the drilling conditions and needs of the pulsation rate (frequency) and magnitude (amplitude) for the downhole pulser.

Additionally the electrical power is used for operation of various instrumentation [160] (FIG. 1) such as accelerometers, photo-multiplier tubes (PMT), crystal gamma ray scintillators and other useful instrumentation sensors and processors. Excess power provides charging for the battery [71500] (FIG. 1) for storage and use under certain conditions where the coil assembly [125] does not generate enough power to operate the MWD device [100] under no flow conditions.

The velocity and consistency of the drilling mud [115] traveling through the lower annular drill collar flow channel [120] may vary due to wellbore conditions generally providing varying forces on the turbine [110]. The varying forces cause the turbine [110] to spin at different velocities exhibiting a wide range of power to be developed by the coil assembly [125]. Fluctuations in the power are regulated through an electrical regulation circuit.

The motor [130] receives a signal from a computer [165] (not shown) that is onboard the MWD device [100] to move the drive shaft [26910]. The motor [130] may be synchronous, asynchronous, or stepper and is activated to fully rotate or to rotationally increment various degrees, depending on the wellbore conditions or the observed signal intensity and/or duration.

Figure 2C:
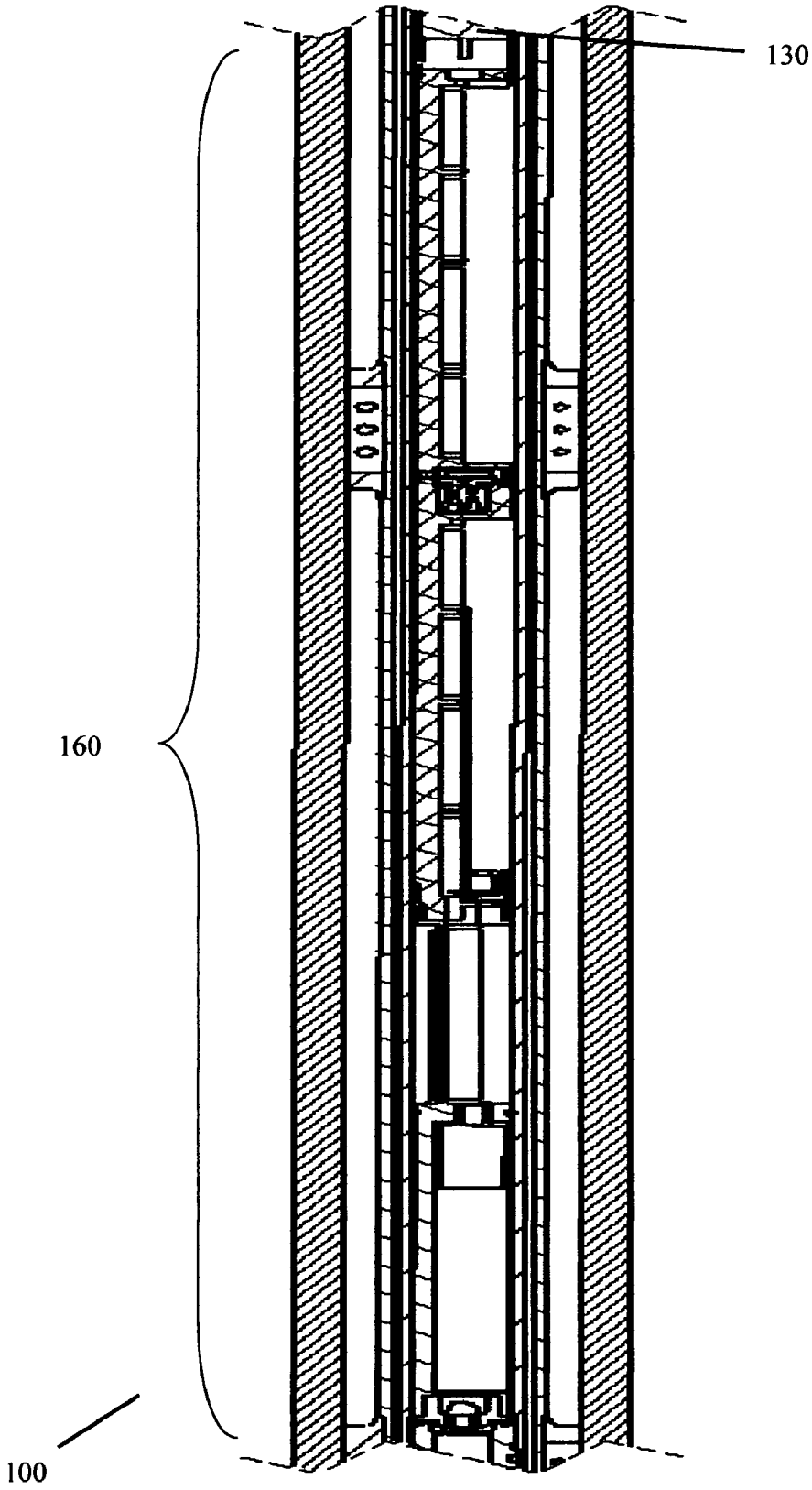
FIG. 2C is a continuation of FIG. 2B, illustrating more of the MWD components, particularly the various instrumentation, starting with the motor assembly through the gamma ray chassis end plug.

FIG. 2C shows the section of the MWD device [100] containing various instrumentation [160], starting with the motor [130]. Standard instrumentation, known to those skilled in the art, may include but are not limited to accelerometers, photo-multiplier tubes (PMT), crystal gamma ray scintillators and other useful instrumentation needed for monitoring drilling, fracing, formations, pressures, and/or temperatures.

Figure 2D:
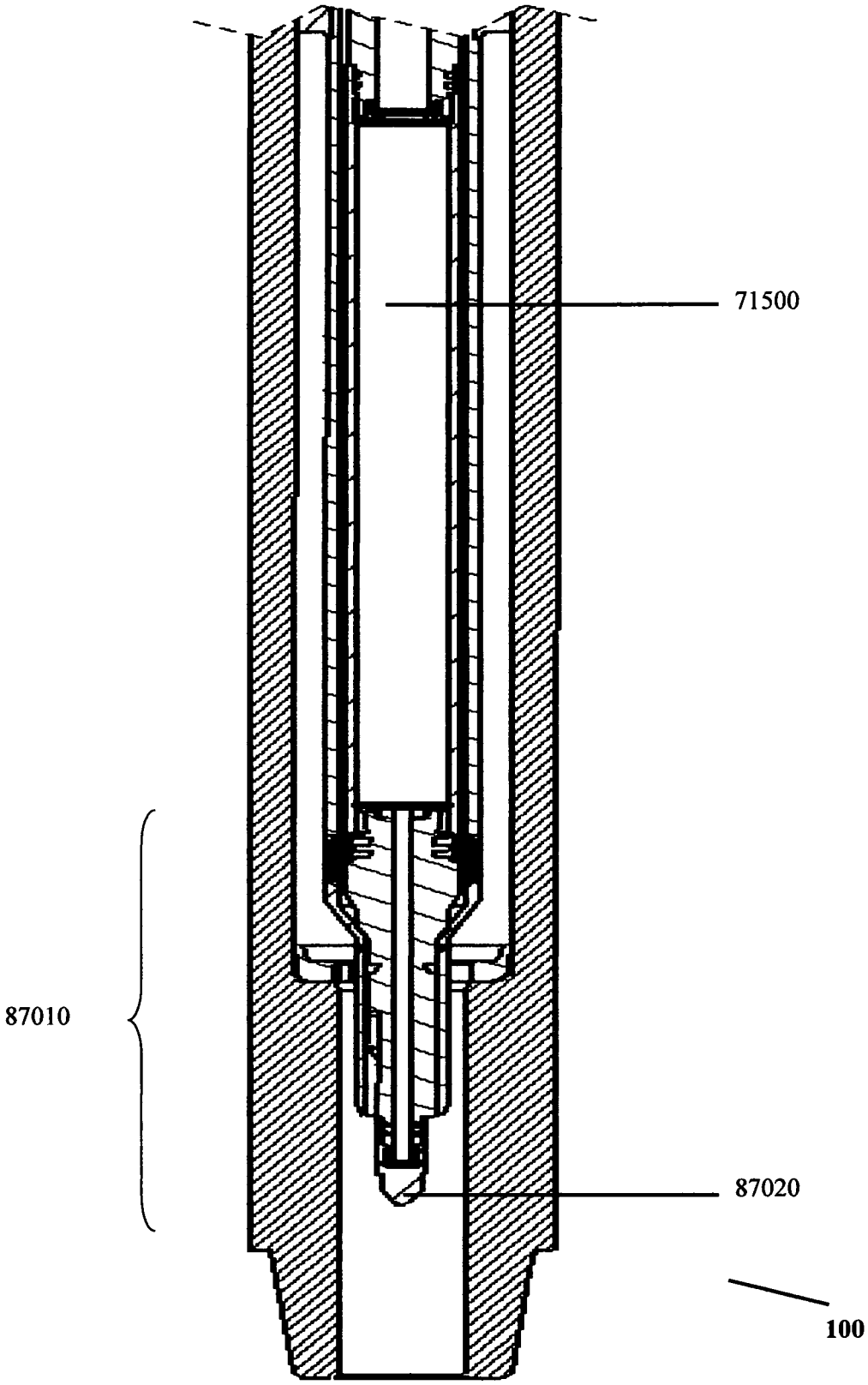
FIG. 2D shows the final section of the MWD device.

FIG. 2D illustrates the final bottom section of the MWD device [100] including the battery [71500], the stinger [87010] and the stinger nose [87020].

Positioning of the flow throttling device (FTD) [26150] (FIG. 3) within the drill collar [29] and utilizing the flow guide [23480] significantly decreases the turbulence of the drilling mud [115]. The force required to move the pilot [26220] into or out of the pilot seat [140] is minimal. Operational power consumption to retain the pilot in any position is less than current MWD device pulsing or fracing technology. The linear motion of the flow throttling device (FTD) [26150] axially along the pulser guide pole [26010] is both up and down (along a bi-axial direction).

Figure 3:
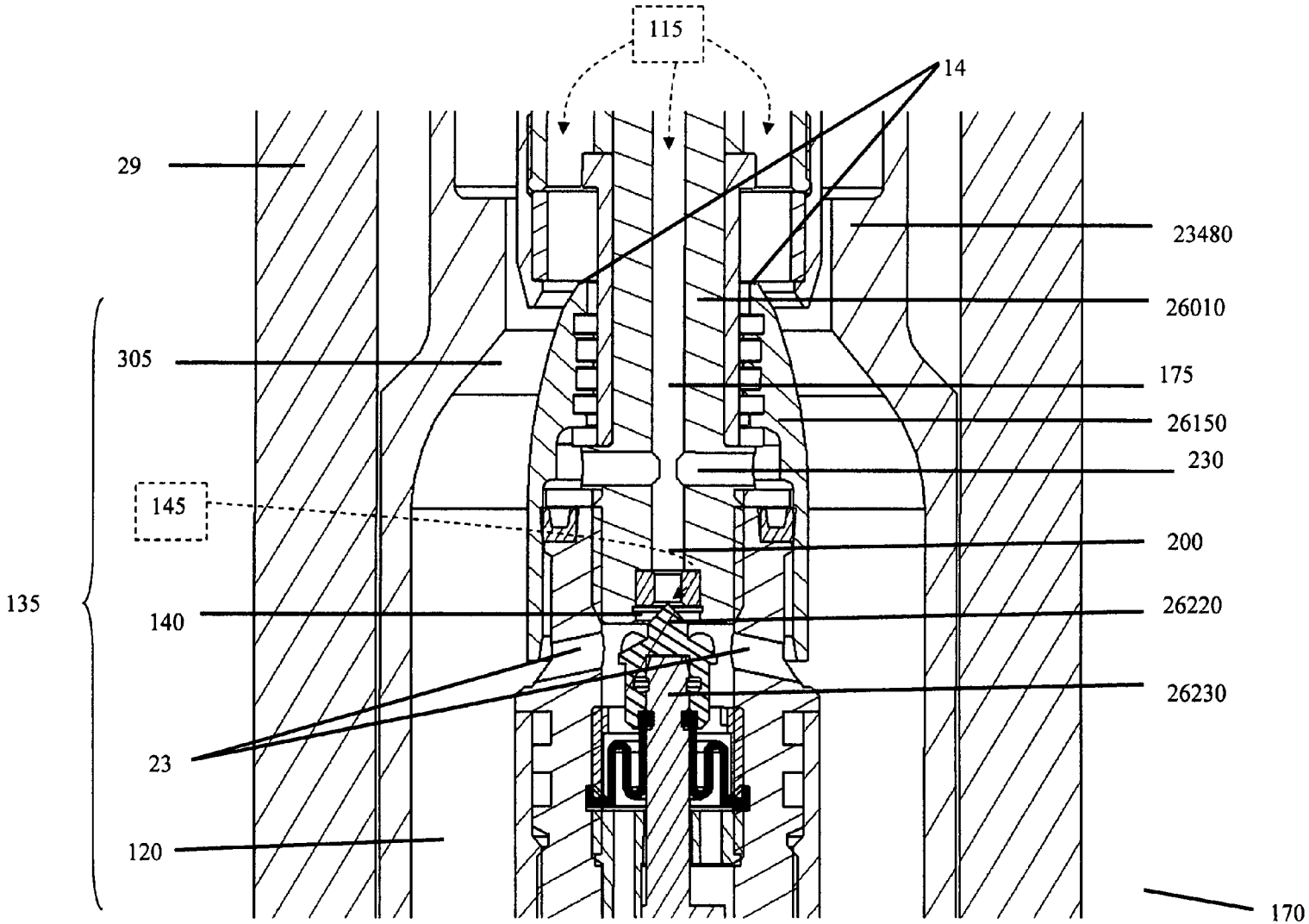
FIG. 3 describes the pulser system operation.

FIG. 3 shows the pulser assembly [170] within a drill collar [29] when in the closed position the pilot actuator assembly [135] moves the pilot [26220] until it is in closed position with the pilot seat [140] where no flow through can occur. The front pilot shaft [26230] is the only portion of the pilot actuator assembly [135] that moves the pilot [26220] in a translational or rotational direction.

For FIG. 3, when the pilot is in closed position, the guide pole channel [175] and the lower flow connecting channels [23] are effectively sealed so that drilling mud [115] flow is completely restricted through the pilot orifice. As this sealing is achieved, drilling mud [115] still enters both the guide pole channel [175] and separately, the lower flow connecting channels [23], thus almost equalizing the pressure across the pilot [26220]. The drilling mud [115] flows through the guide pole channel [175] causing the flow throttling device (FTD) [26150] to rise along the pulser guide pole [26010]. This effectively restricts the middle annular drill collar flow channel [305] from the lower annular drill collar flow channel [120], thereby generating a positive signal pulse at the throttle zone for pulse generation [14] and corresponding signal transmittal, fracing, bit cleansing or drill rate penetration increases due to the hammering and pulsing effect.

Figure 4:
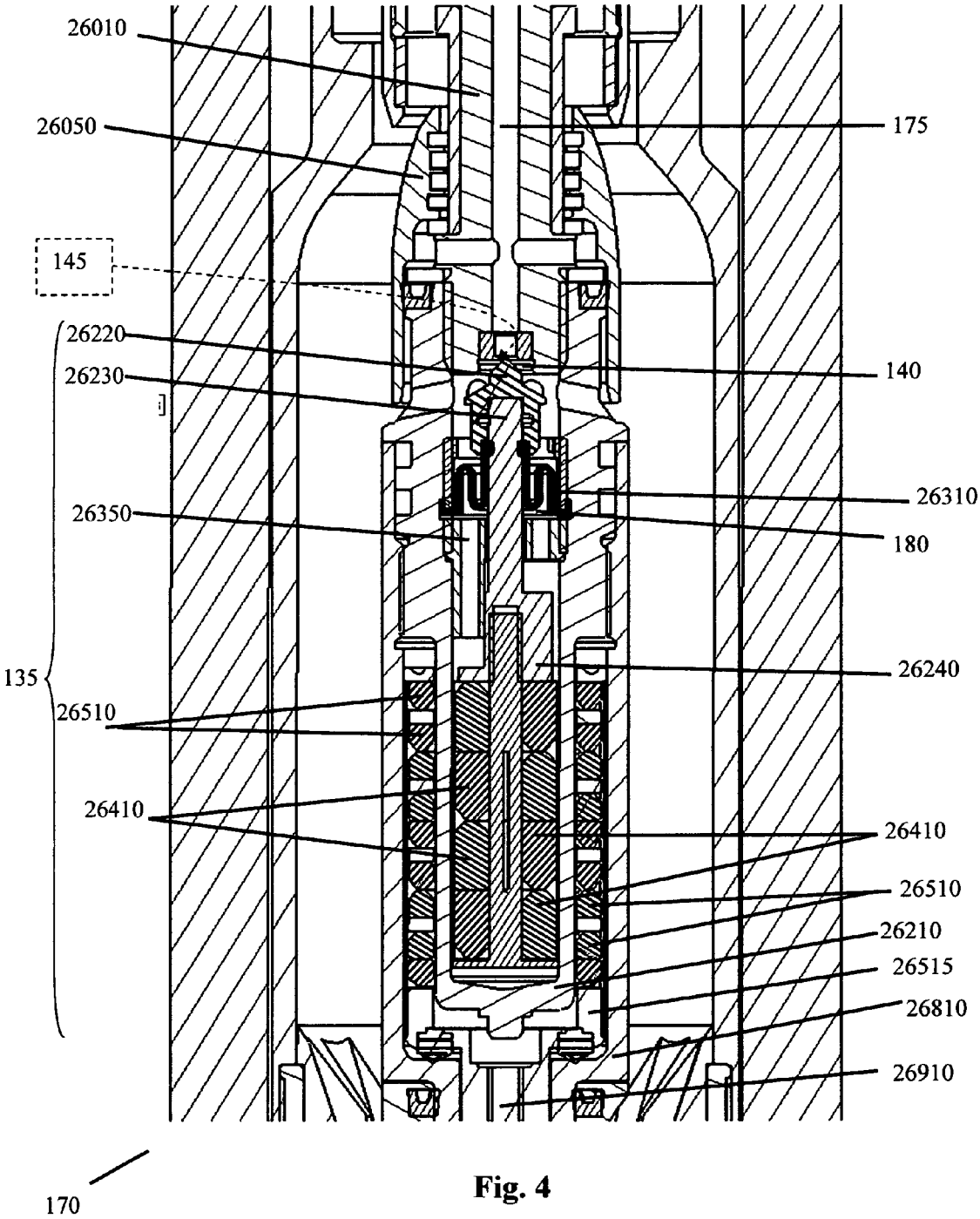
FIG. 4 describes the operation of the magnetic coupling and how the pilot is actuated.

In FIG. 4 starting from the outside portion of the assembly and moving toward the center, the pulser assembly [170] comprising a pulser housing [26810] of a non-magnetic material, and a magnetic pressure cup [26210], which is also comprised of a non-magnetic material, and encompassed by the outer magnets [26510]. The outer magnets [26510] may comprise several magnets, or one or more components of magnetic or ceramic material exhibiting several magnetic poles within a single component. Additionally the magnetic pole positions may be customizable, depending on the drilling conditions, to achieve a clear pressure signal. The outer magnets [26510] are housed in an outer magnet housing [26515] that is attached to the drive shaft [26910]. Within the magnetic pressure cup [26210] is housed the inner magnet assembly, that contains the pilot actuator assembly [135] comprised of the rear pilot shaft [26240] linearly engaged in a front pilot shaft [26230], which is moved longitudinally in the center of the pulser assembly [170]. Within the magnetic pressure cup [26210] is the rear pilot shaft [26240], also comprised of non-magnetic material.

The outer magnets [26510] and the inner magnets [26410] are placed so that the magnetic polar regions interact, attracting and repelling as the outer magnets [26510] are moved about the inner magnets [26410]. Using the relational combination of magnetic poles of the moving outer magnets [26510] and inner magnets [26410], causes the inner magnets [26410] with the rear pilot shaft [26240], to move the pilot actuator assembly [135] linearly and interactively as a magnetic field coupling. The linear motion is along the rear pilot shaft [26240], through the front pilot shaft [26230], the double rolling bellows [26310] and to the pilot [26220] thereby opening or closing the passage between the pilot [26220] and the pilot seat [140]. The use of outer magnets [26510] and inner magnets [26410] to provide movement from rotational motion to linear motion also allows the motor [130] (FIG. 2B) to be located in an air atmospheric environment in lieu of the use of a lubricating fluid [180] environment inside the magnetic pressure cup [26210]. This also allows for a decrease in the cost of the motor [130] (FIG. 2B), decreased energy consumption and subsequently decreased cost of the actual MWD/pulser device [100] (FIG. 1). It also alleviates the possibility of flooding the tool instead of the use of a moving mechanical seal and the time and effort to effect and maintain a pressure compensating system.

Switching fields between the outer magnets [26510] and the inner magnets [26410] provides a magnetic spring like action that allows for pressure relief by moving the pilot [26220] away from the pilot seat [140] thereby regulating the pulse magnitude. Additionally the outer magnets [26510], operate in the lower pressure of the pulser housing [26810] as opposed to the higher pressure within the magnetic pressure cup [26210], allowing for a greatly reduced need in the amount of energy required by the motor to longitudinally move the pilot actuator assembly [135].

The front pilot shaft [26230] passes through the anti-rotation block [26350] located below the double rolling bellows [26310]. The anti-rotation block [26350] located near the double rolling bellows is secured to the inside of the magnetic pressure cup [26210] and restricts the rotational movement of the front pilot shaft [26230].

Figure 5:
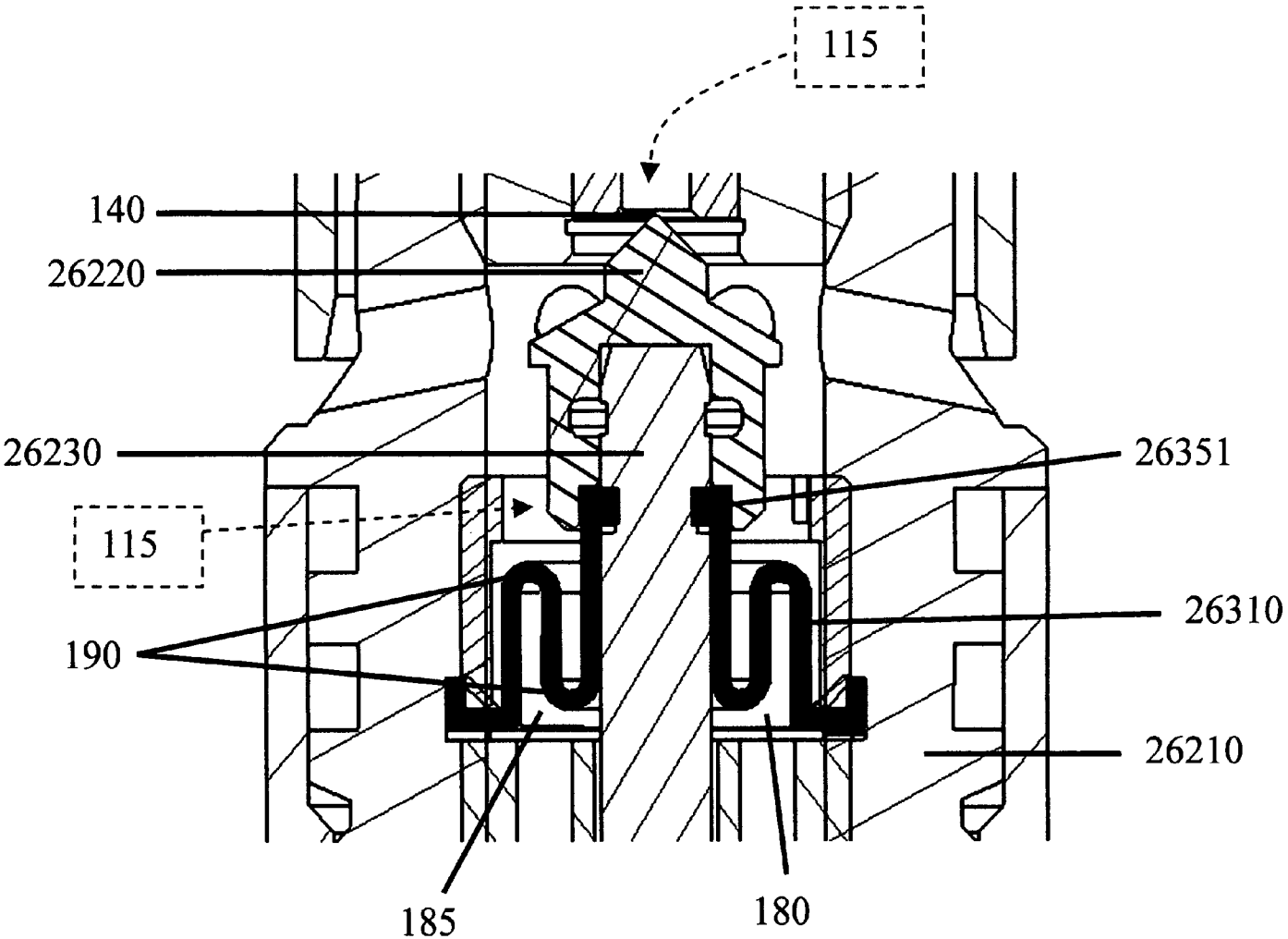
FIG. 5 describes the double rolling bellows operation.

Referring to FIG. 5, an embodiment of the double rolling bellows [26310] includes sealing a portion of the surface of the front pilot shaft [26230] engaged around a pilot shaft land [26351] and the interior of the hollow magnetic pressure cup [26210]. Sealing of the double rolling bellows [26310] keeps drilling mud [115] from entering the bellows chamber [185] and intermingling with the inner magnet chamber lubricating fluid [180] when the pilot [26220] is moved to an open position off the pilot seat [140]. Another embodiment is to allow the double rolling bellows [26310] to move linearly, concurrent with the front pilot shaft [26230]. The design of the double rolling bellows [26310] interacting with the front pilot shaft [26230] and the bellows chamber [185] allow the double rolling bellows [26310] to conform to the space constraints of the bellows chamber [185] providing flexible sealing without the double rolling bellows [26310] being displaced by the drilling mud [115]. It was also found that the double loop [190] configuration of the double rolling bellows [26310] consumes much less energy than previous designs thereby reducing the overall consumption of energy. Energy consumption is also reduced by pre-filling the bellows chamber [185] with appropriate lubricating fluid [180]. This allows for reduction of the pressure differential on both sides of the double rolling bellows [26310]. The smaller pressure differential enhances performance by the double rolling bellows [26310] and minimizes wear and energy consumption. The lubricating fluid [180] may be petroleum, synthetic or bio-based and should exhibit compression characteristics similar to hydraulic fluid. The double loop [190] configuration of the double rolling bellows is designed to minimize energy consumption.

Figure 6:
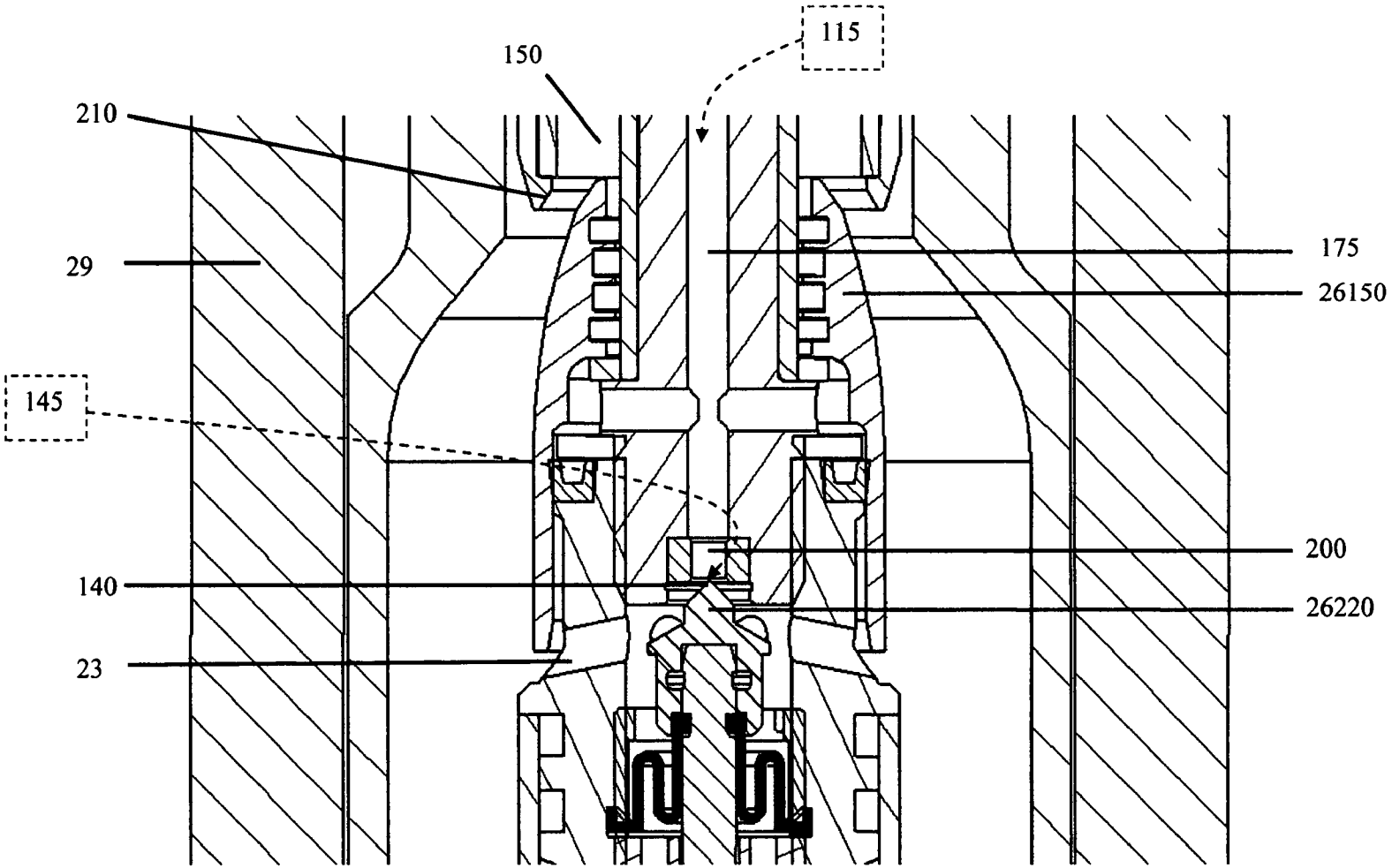
FIG. 6 describes the guide pole channel and orifice chamber.

FIG. 6 shows another embodiment of the present disclosure pertaining to the configuration of the guide pole channel [175] and orifice chamber [200] in the proximity of the pilot seat [140] and pilot seat orifice [145]. When the pilot [26220] is in contact with the pilot seat [140] the flow throttling device (FTD) [26150] moves toward the flow throttling device (FTD) seat [210]. Conversely (and inversely), when the pilot [26220] is not contacting the pilot seat [140] the flow throttling device (FTD) [26150] withdraws from the flow throttling device (FTD) seat [210]. The pressure differential between the drilling mud [115] pressure and the orifice chamber [200] moves the flow throttling device (FTD) [26150] more rapidly, enabling a very forceful restriction of the flow throttling device (FTD) orifice [150] and a very defined pulse and therefore clearer signals which are more easily interpreted.

Figure 7:
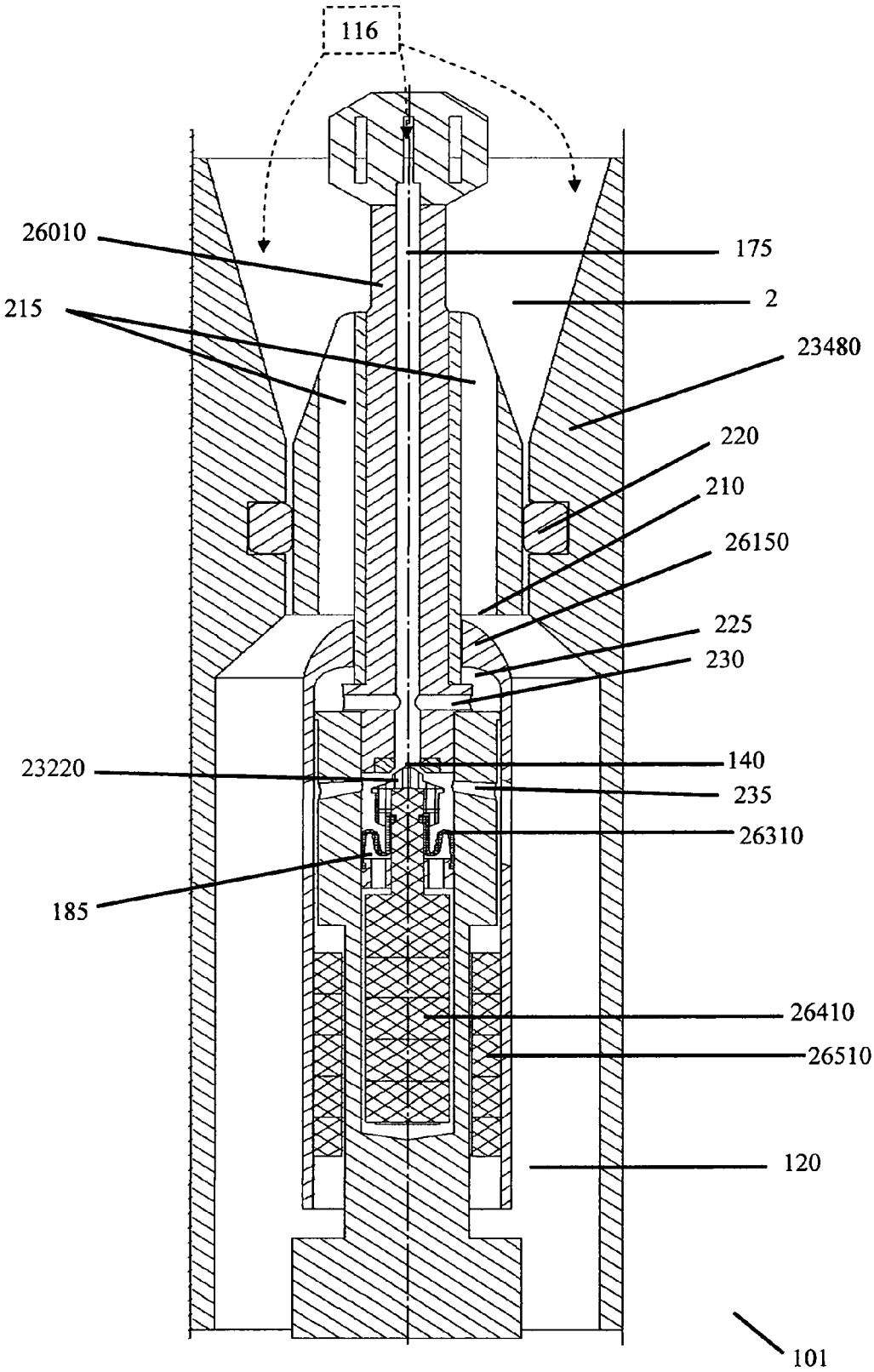
FIG. 7 describes a cross section of a downhole pulse generating device in the open position.

FIG. 7 is an alternate view of cross-section of a pulsing/fracturing/drilling (PFD) device [101] showing the PFD device [101] without a drill collar [29]. The pulsing/fracturing/drilling (PFD) medium [116] flows into the upper annular drill collar flow channel [2] located inside the flow guide [23480] which may be integral to the collar [29]. Internal to the flow guide [23480] is a pulser guide pole [26010] which allows the flow throttling device (FTD) [26150] to move axially along the pulser guide pole [26010] where the flow throttling device (FTD) [26150] will contact the flow throttling device (FTD) seat [210] thereby sealing off the outer annular drill collar flow channels [215]. The flow guide seal [220] keeps or PFD medium [116] from flowing around the flow guide [23480] thereby ensuring that the PFD medium [116] only flows through the outer annular drill collar flow channels [215] and through the guide pole channel [175].

FIG. 7 shows the flow throttling device (FTD) [26150] in the open position and the pilot [23220] in the closed position sitting within the pilot seat [140], where the flow throttling device (FTD) [26150] is away from the flow throttling device (FTD) seat [210] allowing the flow throttling device (FTD) pressure chamber [225] to fill with or PFD medium [116] through the pilot connecting channel [230] via the guide pole channel [175]. As the flow throttling device (FTD) pressure chamber [225] fills with PFD medium [116], the flow throttling device (FTD) [26150] moves up within the flow guide [23480] due to hydraulic pressure caused by the or PFD medium [116] exerting a hydraulic force acting on the flow throttling device (FTD) [26150] in the flow throttling device (FTD) pressure chamber [225]. The force acts to push the flow throttling device (FTD) [26150] up within the flow guide [23480] and subsequently moves the outer magnets [26510] in the same direction. The outer magnets [26510] continue to move up and subsequently the opposing magnetic fields of the outer magnets [26510] pass the center of the magnetic fields of the inner magnets [26410]. The inner magnets [26410] attached to the pilot [23220] then, due to the magnetic fields, move in the opposite direction as the outer magnets [26510] cause the pilot [23220] to move down, in the same direction as the inner magnets [26410], thereby moving the pilot [23220] off the pilot seat [140]. Movement of the pilot [23220] off the pilot seat [140] allows or PFD medium [116] to flow through the pilot exhaust channels [235] into the lower annular drill collar flow channel [120] thereby relieving pressure in the flow throttling device (FTD) pressure chamber [225]. Release of this pressure causes the flow throttling device (FTD) [26150] to reverse direction away from the flow throttling device (FTD) seat [210]. During the downward motion of the flow throttling device (FTD) [26150], the outer magnets [26510] move downward thereby moving past the center of the magnetic fields of the inner magnets [26410] subsequently causing the inner magnets [26410] to move in an upward direction, again due to opposing magnetic fields. The upward movement of the inner magnets [26410] moves the pilot [23220] into the pilot seat [140] causing the flow throttling device (FTD) pressure chamber [225] to refill to repeat the aforementioned cycle.

The outer magnets [26510] are stacked in position such that the fields are in opposition to each other. For example the stack top magnetic end is "N" and the bottom end is "S". Moving down to the next magnet the field is "S" on the top and "N" on the bottom. Repeating the first sequence, the top end is "N" and the bottom end is "S". The inner magnets [26410] fields are stacked similarly. The movement of the similar magnetic fields of the outer magnets [26510] to the inner magnets [26410] causes repulsion of the flow throttling device (FTD) [26150] and the pilot [23220] basically holding the pilot [23220] in position until the outer magnet passes the center field of the opposing inner magnet [26410] which is an opposite pole and therefore repelled by the outer magnet [26510] causing the inner magnet [26410] to move in the opposite direction as the outer magnet [26510].

Additionally, the pilot [23220] is attached to the inner magnets [26410] and through a double rolling bellows [26310] which resides in a bellows chamber [185]. The bellows chamber [185] is filled with a viscous liquid and also acts as a dampening source for the pilot [23220].

Figure 8:
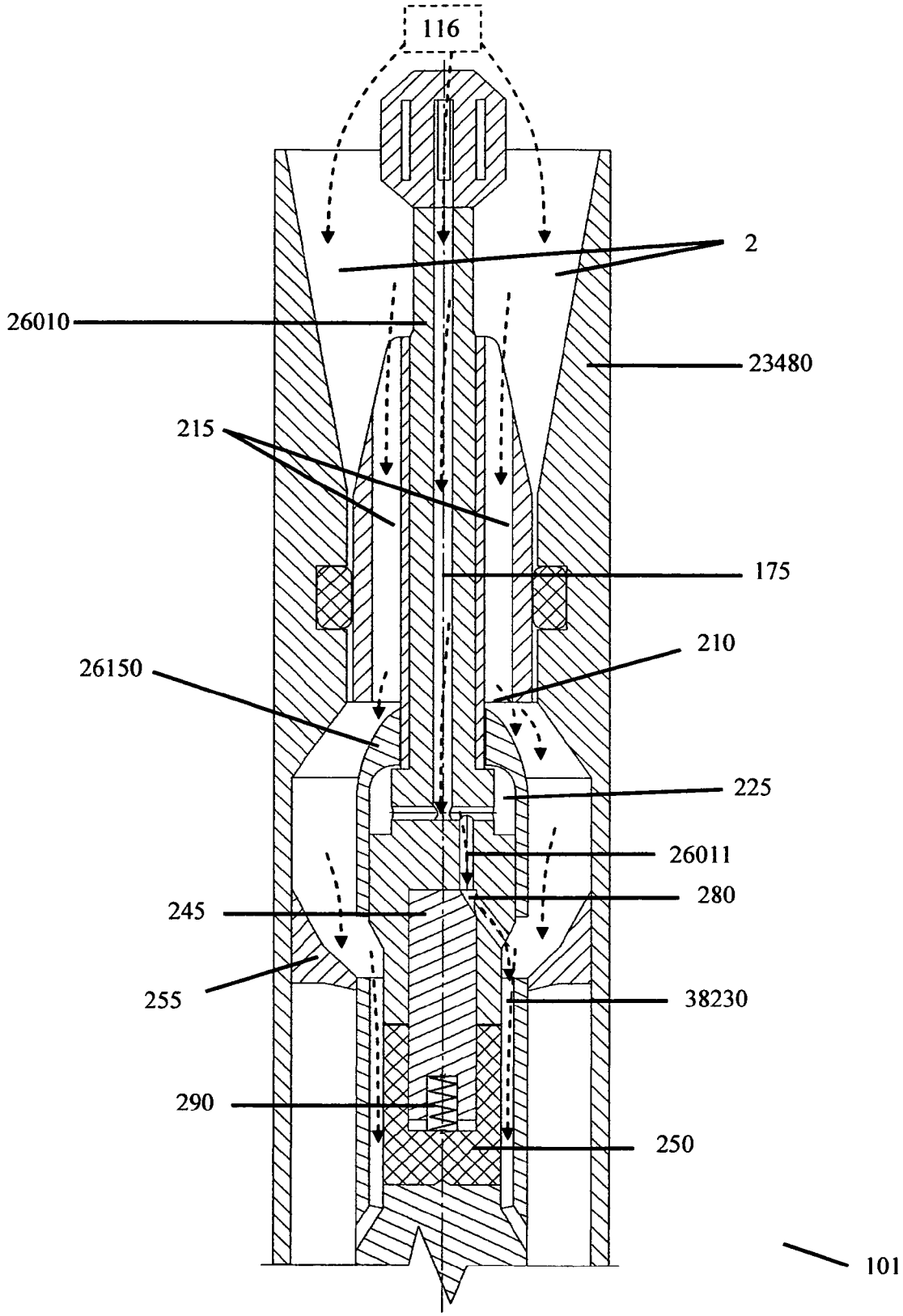
FIG. 8 describes a downhole pulse generating device powered by a positive displacement motor or turbine with a rotating valve flow bevel.

FIG. 8 shows a cross section of a pulsing/fracturing/drilling (PFD) device [101] without the drill collar [29] where the (fluid or gas) PFD medium [116] (the dashed arrows indicate direction of flow) flows into the flow guide [23480] and into the upper annular drill collar flow channel [2] and also into the pulser guide pole [26010] in the pilot flow channel [175]. The PFD medium [116] from the upper annular drill collar flow channel [2] flows through the outer annular drill collar flow channels [215] when the flow throttling device (FTD) [26150] is in the open position and not in contact with the flow throttling device (FTD) seat [210]. When the flow throttling device (FTD) [26150] is in the open position the PFD medium [116] flows unrestricted around the flow throttling device (FTD) [26150] to the bypass flow regulator [255]. PFD medium [116] from the bypass flow regulator [255] continues through the turbine blades [38230] thus rotating the rotating motor [250] and the rotating pilot valve [245]. Linear movement of the flow throttling device (FTD) [26150] is caused by the PFD medium [116] that is moving through the pulser guide pole [26010] in the guide pole channel [175] and exiting into the flow throttling device (FTD) pressure chamber [225] above the rotating pilot valve [245]. The rotating pilot valve [245] includes a feature noted as the rotating valve flow bevel [280] and is coupled to a rotating motor [250]. The rotating motor [250] provides rotational motion to the rotating pilot valve [245]. The upper portion of the rotating pilot valve [245] resides at the bottom of the pulser guide pole [26010] and, upon rotation, allows the rotating valve flow bevel [280] to seal and unseal the guide pole exit channel [26011]. Sealing the guide pole exit channel [26011] forces the PFD medium [116] to flow into the flow throttling device (FTD) pressure chamber [225] thereby hydraulically moving the flow throttling device (FTD) [26150] up the pulser guide pole [26010] until it contacts the flow throttling device (FTD) seat [210] closing off the outer annular drill collar flow channels [215].

The rotating motor [250] rotates the rotating pilot valve [245] such that the rotating valve flow bevel [280] passes the guide pole exit channel [26011] allowing for the PFD medium [116] in the flow throttling device (FTD) pressure chamber [225] to evacuate, thereby reducing the hydraulic pressure acting on the flow throttling device (FTD) [26150] and allowing the flow throttling device (FTD) [26150] to move downward on the pulser guide pole [26010] unsealing the outer annular drill collar flow channels [215].

Eventually the rotational motion of the rotating pilot valve [245] moves the rotating valve flow bevel [280] past the guide pole exit channel [26011], sealing the guide pole exit channel [26011] and creating back pressure within the guide pole channel [175] and refilling the flow throttling device (FTD) pressure chamber [225].

Additionally there is a high pressure relief spring [290] that, should the rotating motor [250] fail, allows the rotating pilot valve [245] to move away from the guide pole exit channel [26011] allowing PFD medium [116] to evacuate the system.

Figure 9:
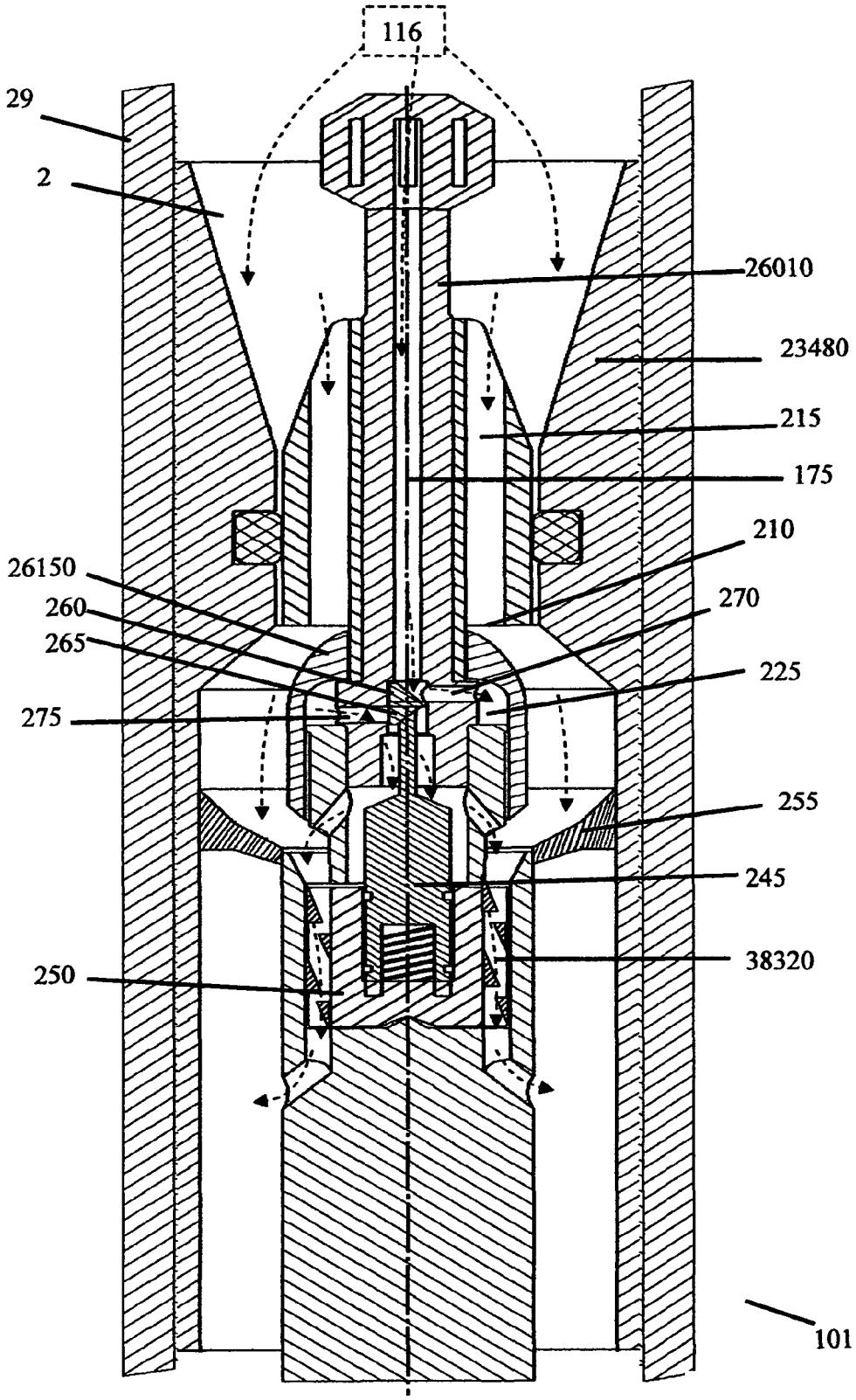
FIG. 9 describes a downhole pulse generating device with an alternate valving for filling the pressure chambers.

FIG. 9 shows a cross section of a PFD device [101] in a drill collar [29] where the PFD medium [116] (the dashed arrows indicate direction of flow) flows into the flow guide [23480] into the upper annular drill collar flow channel [2] and also into the pulser guide pole [26010] in the guide pole channel [175]. The PFD medium [116] from the upper annular drill collar flow channel [2] flows through the outer annular drill collar flow channels [215] when the flow throttling device (FTD) [26150] is in the open position and not in contact with the flow throttling device (FTD) seat [210]. When the flow throttling device (FTD) [26150] is in the open position, the PFD medium [116] flows unrestricted around the flow throttling device (FTD) [26150] to the bypass flow regulator [255]. PFD medium [116] from the bypass flow regulator [255] continues moving down the outer annular drill collar flow channels [215] where it contacts the turbine blade [38230] causing the turbine blade [38230] to rotate the rotating motor

[250]. Thus the linear motion of the PFD medium [116] is converted into rotational motion at the rotating motor [250]. The rotating motor [250] then rotates the rotating pilot valve [245] within the flow throttling device (FTD) [26150]. The rotating pilot valve [245] has a top angled cutout [260] and a bottom angled cutout [265] that are located at the top-most portion of the rotating pilot valve [245] within the lower end of the pulser guide pole [26010]. The PFD medium [116] in the guide pole channel [175] within the pulser guide pole [26010] contacts the top angle cutout [260] of the rotating pilot valve [245] that is rotating due to the rotational movement of the rotating motor [250]. When the angle of the rotating top angled cutout [260] coincides with the chamber inlet channel [270] within the pulser guide pole [26010], PFD medium [116] is allowed to enter the flow throttling device (FTD) pressure chamber [225]. The PFD medium [116] then exerts a hydraulic pressure raising the flow throttling device (FTD) [26150] until it contacts the flow throttling device (FTD) seat [210] shutting off the flow of PFD medium [116] through the outer annular drill collar flow channels [215]. With the rotating pilot valve [245] continuing to rotate, the top angled cutout [260] passes by the chamber inlet channel [270] thus sealing off any PFD medium [116] flow into the flow throttling device (FTD) pressure chamber [225]. The bottom angled cutout [265] then coincides with the chamber exhaust channel [275] allowing the evacuation of PFD medium [116] from the flow throttling device (FTD) pressure chamber [225] and causing the flow throttling device (FTD) [26150] to move away from the flow throttling device (FTD) seat [210] and allowing PFD medium [116] to flow again through the outer annular drill collar flow channels [215]. The movement of the flow throttling device (FTD) [26150] against and away from the flow throttling device (FTD) seat [210] thereby opening and closing the outer annular drill collar flow channels [215] sends a pressure pulse through the PFD medium [116], causing cleansing of any drill bit that may be attached. The pulse causes an increased removal of cuttings from any sort of drilling operation, annular area, or drill bit teeth or jets and also assists in fracturing formations due to the high shear pressures caused in the sudden release (shock) of a tremendous volume PFD medium [116] or of any fluid/gas column. The large pressure pulses caused at the location of the perforations/liner/etc. are hydraulically amplified like a hammering action upon any sort of drill bit mechanism attached to it. One frac truck could be used instead of 10, and the hydraulic fracture pressure would be amplified higher than what is presently used today and also done exactly at the location of the perforations/liner/etc. where it is needed the most. This could increase the size of the fracture job and how deeply into the formation the fracture is propagated and how many fracture lines (i.e.: increased surface area opened by the fracture, actually branch out to enhance the flow ability of the formation) are created and increase production from any well exponentially. In a drilling operation, it would increase the ROP (rate of penetration). In tertiary recovery operations, this would also limit the size and amount of pumps required to perform the injection process, since the hydraulic amplification (PFD device) could be set down near where the wellbore encounters the formation where it is pushing out into.

The top angled cutout [260] and the bottom angled cutout [265] are continuously rotated as part of the rotating valve [245] any time the PFD medium [116] is being used. Passage of the top angled cutout [260] and the bottom angled cutout [265] by the chamber inlet channel [270] and the chamber exhaust channel [275] act to provide a constantly intermittent flow of PFD medium [116] through the flow throttling device (FTD) pressure chamber [225]. The rotational frequency of the top angled cutout [260] and the bottom angled cutout [265] by the chamber inlet channel [270] and the chamber exhaust channel [275] determine the pressure pulse duration and frequency. Rotational speeds (frequency) and pulse amplitudes (pressure pulse sizes) are variable, depending on the operator's settings and what is intended.

Additionally, the pulser guide pole [26010] allows for the chamber inlet channel [270] and the chamber exhaust channel [275] to be linearly offset so that the top angled cutout [260] never aligns with the chamber exhaust channel [275] and in parallel, the bottom angled cutout [265] never aligns with the chamber inlet channel [270].

Figure 10:
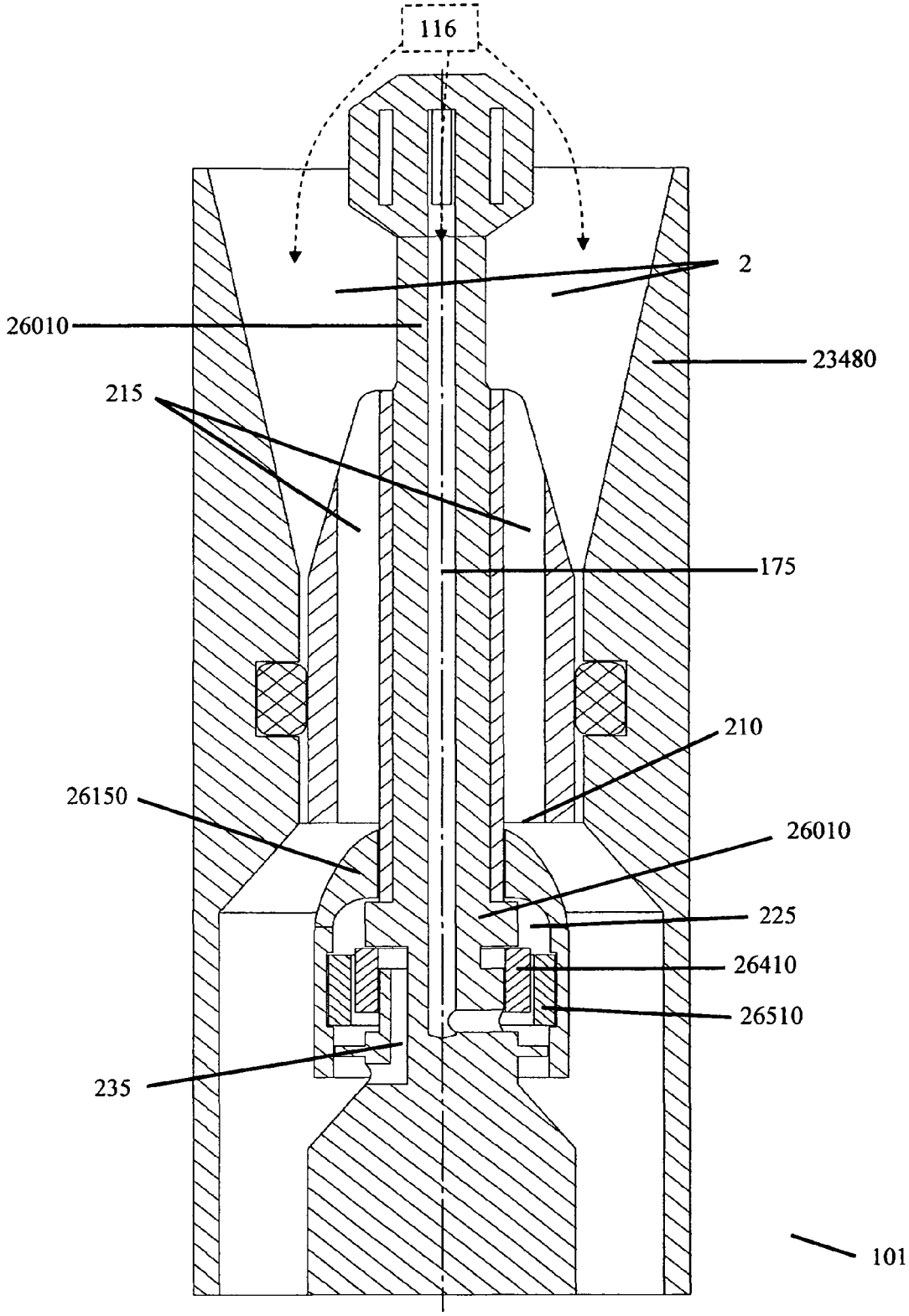
FIG. 10 describes a downhole pulse generating device where the inner and outer magnets are contained within the flow throttling device (FTD).

FIG. 10 is a cross section of a PFD device [101] without the drill collar [29] (not shown) where the PFD medium [116] (the dashed arrows indicate direction of flow) flows into the flow guide [23480] and into the upper annular drill collar flow channel [2] and also into the guide pole channel [175]. The PFD medium [116] from the upper annular drill collar flow channel [2] flows through the outer annular drill collar flow channels [215] when the flow throttling device (FTD) [26150] is in the open position and not in contact with the flow throttling device (FTD) seat [210].

The flow throttling device (FTD) [26150] has, within and attached to it, outer magnet [26510] which is arranged in detail as explained in FIG. 7. Inner magnets [26410] move axially along the pulser guide pole [26010] to open and close the pilot exhaust channels [235] and the pilot connecting channels [230] (shown if FIG. 7). When the flow throttling device (FTD) [26150] moves down to open position the outer magnets [26510] attached to the flow throttling device (FTD) [26150] move with the flow throttling device (FTD) [26150] past the inner magnets [26410] causing the magnetic field of the outer magnets [26510] to repel the magnetic field of the inner magnets [26410] moving the inner magnets [26410] upward to close off the pilot exhaust channels [235]. The PFD medium [116] flows down the pilot flow channel [175] and flows through the pilot connecting channels [230] (shown in FIG. 7) into the flow throttling device (FTD) pressure chamber [225] creating a hydraulic pressure that moves the flow throttling device (FTD) [26150] upwards to contact the flow throttling device (FTD) seat [210] thus closing off the outer annular drill collar flow channels [215]. The flow throttling device (FTD) [26150] moves up to closed position due to the hydraulic pressure within the flow throttling device (FTD) pressure chamber [225], the outer magnets [26510] attached to the flow throttling device (FTD) [26150] move with the flow throttling device (FTD) [26150] past the inner magnets [26410] causing the magnetic field of the outer magnets [26510] to repel the magnetic field of the inner magnets [26410] moving the inner magnets [26410] downward to open up the pilot exhaust channels [235] and closing off the pilot connecting channels [230] (shown in FIG. 7) decreasing the hydraulic pressure in the flow throttling device (FTD) pressure chamber [225] and allowing the flow throttling device (FTD) [26150] to move downward to open position and thus repeating the cycle.

Due to the arrangement of the magnetic poles at the ends of the magnets [26410, 26510] and their orientation within the flow throttling device (FTD) [26150] the passing of the outer magnets [26510] causes the inner magnets [26410] to repel the inner magnets [26410] to move upward thereby sealing the flow throttling device (FTD) pressure chamber [225]. In this position the inner magnets [26410] open up the pilot exhaust channels [235] where pressure is relieved from the flow throttling device (FTD) pressure chamber [225] and the flow throttling device (FTD) [26150] is pushed down the pulser guide pole [26010].

Movement of the flow throttling device (FTD) [26150] and outer magnets [26510] downward allows the outer magnets [26510] to travel past the inner magnets [26410], magnetically attracting the inner magnets [26410] off the openings for the flow throttling device (FTD) pressure chamber [225]. The outer magnets [26510] move down to cover the pilot exhaust channels [235] opening up the pilot connecting channel [230] (shown in FIG. 7) to allow for filling of the flow throttling device (FTD) pressure chambers [225]. As described in FIG. 10, the inner magnets [26410] act as valving to open and close the flow throttling device (FTD) pressure chamber [225] and the pilot connecting channel [230] (shown in FIG. 7).

Figure 11:
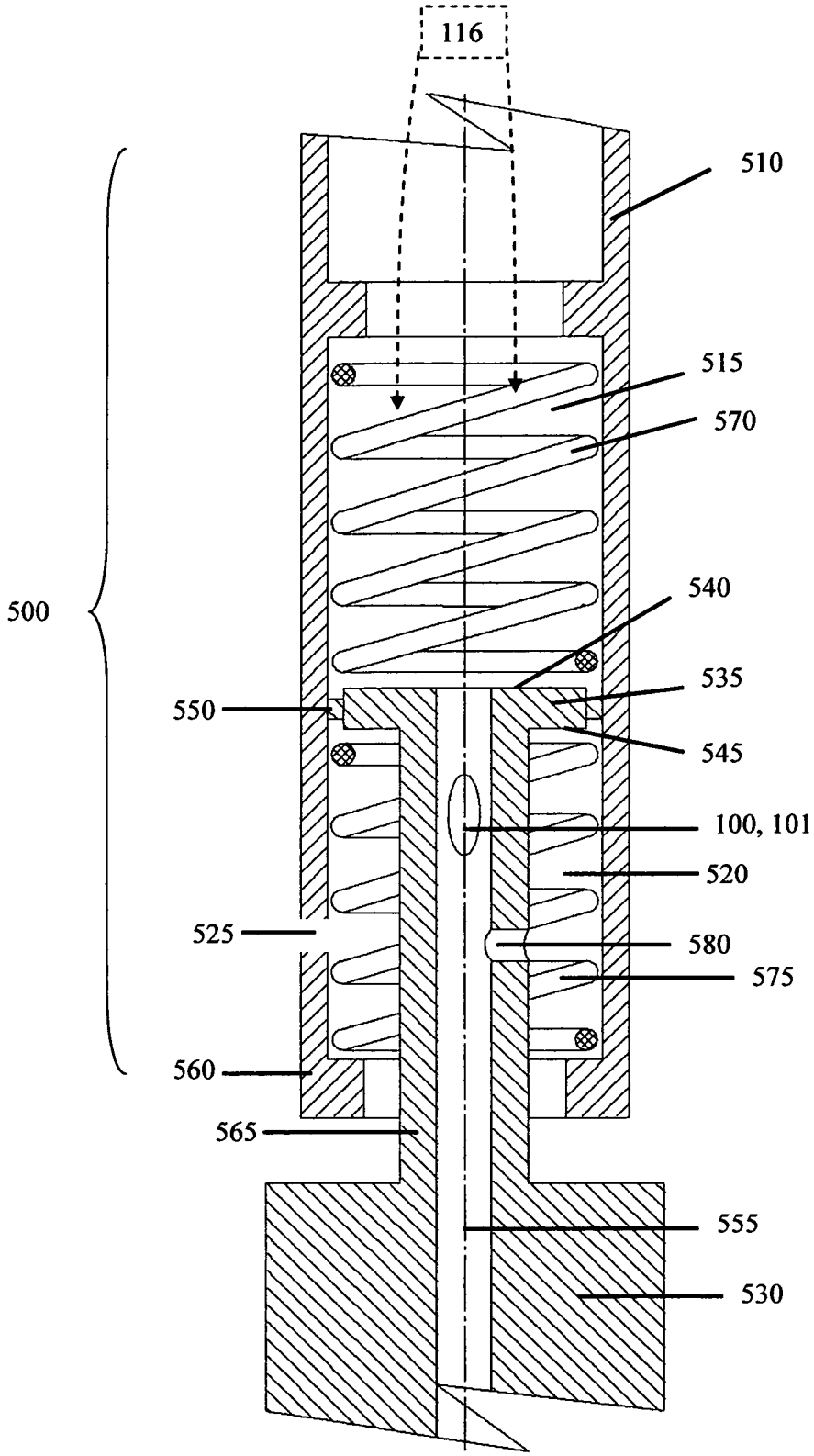
FIG. 11 describes a downhole pulse generating device where the flow through, a drill string adapter, and alternative measurement while drilling device allows for annular drill collar flow that is directed to the drilling bit to aid in clearing debris from the drill head.

FIG. 11 provides a schematic for a drill string adapter [500] with an outer casing [510] with an upper pressure chamber [515] and a lower pressure chamber [520]. The lower pressure chamber [520] has one or more vent channel [525] which allows for internal pressure to be equal to that of the annulus pressure. Additionally, a drill bit adapter [530] is shaped such that a piston land [535] with a top land surface [540] and a bottom land surface [545] and land seal [550] are axially moveable and define a variable volume within the upper pressure chamber [515] and lower pressure chamber [520]. The drill bit adapter [530] also has a centrally located adapter channel [555] through which PFD medium [116] flows to the drilling head [not shown].

The lower pressure chamber [520] has an internal lower end spline [560] through which an external drill bit adapter spline [565] fits. The internal lower end spline [560] and external drill bit adapter spline [565] allow for axial movement of the drill bit adapter [530] independent of the drill string adapter [500]. The intermeshing of the internal lower end spline [560] and the external drill bit adapter spline [565] interlock the drill string adapter [500] and the drill bit adapter [530] so that they move as a unit rotationally.

The upper pressure chamber [515] contains an upper spring [570] which functions to provide a variable pressure on the top land surface [540] of the piston land [535] thereby transmitting that force through the piston land [535] to the drill bit adapter [530]. The upper spring [570] compensates for variations in movement of the drill bit [not shown] and subsequently the drill bit adapter [530]. The lower pressure chamber [520] includes a lower spring [575] which resides below the piston land [535] and the drill bit adapter [530] and contacts the bottom land surface [545]. The lower spring [575] and the upper spring [570] act in opposing direction (inversely) to each other on the piston land [535], bottom land surface [545] and the top land surface [540] thereby dampening the axial motion of the drill bit adapter [530].

Optionally, this design may be a drill bit adapter vent [580] from the adapter channel [555] to the lower pressure chamber [520] for an MWD [100] or PFD device [101] such that the vent channel [525] may be capped or blocked. Installation of an MWD device [100] or PFD device [101] may be installed within the adapter channel [555].

What is claimed is:

1. An apparatus for generating pressure pulses flowing within a drill string, comprising:

a pulsing/fracturing/drilling (PFD) generating device longitudinally and axially positioned within an annular drill collar flow channel in a region above or below the drill bit, a positive displacement motor, or a rotary steerable tool; wherein said PFD device is situated either near the formation of interest requiring injection for tertiary recovery or is situated adjacent to a formation that is being fractured such that the pulsing/fracturing/drilling (PFD) medium (liquid or gas) flows through said annular drill collar flow channel and said PFD medium is guided into two sets of selectively reversible flow, pilot and lower flow connecting channels, wherein said connecting channels are connected to the guide pole channel and said annular drill collar flow channel, and wherein said annular drill collar flow channel is acted upon by one or more flow throttling devices thereby transmitting signals, wherein said flow throttling devices (FTD) utilizes a turbine residing within proximity of a flow diverter that diverts said PFD medium in said annular drill collar flow channel into and away from turbine blades such that the force of said PFD medium causes said turbine blades and said turbine to rotationally spin around a coil assembly.

2. The apparatus of claim 1, wherein said apparatus for generating pulses includes a pilot actuator assembly comprising, a pilot, a pilot shaft, a double rolling bellows, at least one flow throttling device (FTD), a bellows chamber, and a pulser guide pole, wherein pilot and lower flow connecting channels provide for reversal of flow and wherein said pilot seals a middle annular drill collar flow channel from said lower annular drill collar flow channel and such that said flow throttling device (FTD) and said pilot are capable of bi-directional axial movement along or within said pulser guide pole.

3. The apparatus of claim 2, wherein said coil assembly generates electrical power for operating a motor and other operating equipment useful for instrumentation, said motor comprising a drive shaft centrally located between said motor and a magnetic pressure coupling wherein said motor and said coupling are mechanically coupled such that said motor rotates said magnetic pressure coupling outer magnets and moves said pilot actuator assembly.

4. The apparatus of claim 2, wherein a magnetic coupling is formed by a location external and internal to said magnetic pressure cup where outer magnets are placed in relation to inner magnets, said inner magnets located in a position inside a magnetic pressure cup, said coupling allowing for translating rotational motion of said motor and outer magnets to linear motion of said inner magnets via a magnetic polar interaction, wherein linear motion of said inner magnets move said pilot actuator assembly, thereby linearly moving a pilot into a pilot seat, closing a pilot seat orifice, lifting a flow throttling device (FTD) into a flow throttling orifice and thereby generating a pulse wherein further rotation of said motor drive shaft, and outer magnets move said pilot actuator assembly and said pilot away from said pilot seat causing said flow throttling device (FTD) to move away from said flow throttling orifice, thereby ending the positive pulse.

5. The apparatus of claim 2, wherein said apparatus includes a pulser guide pole capable of providing a path for said pilot and said flow throttling device (FTD) for operation in a bi-directional axial movement.

6. The apparatus of claim 2, wherein said pilot actuator assembly is comprised of a rear pilot shaft, front pilot shaft, and pilot.

7. The apparatus of claim 2 wherein differential pressure is minimal in that slight force acting on a small cross-sectional area of a pilot seat defines a pressure that is required to either engage or disengage said pilot.

8. The apparatus of claim 1, wherein said apparatus is without said drill collar and where the PFD medium flows into a flow guide and into an annular drill collar flow channel and also into a guide pole channel within the pulser guide pole such that said PFD medium from said annular drill collar flow channel flows through outer annular drill collar flow channels when said flow throttling device (FTD) is in the open position and not in contact with a flow throttling device (FTD) seat.

9. The apparatus of claim 1, wherein when said flow throttling device (FTD) is in the open position said PFD medium flows unrestricted around flow throttling device (FTD) bypass flow regulators and wherein said PFD medium from said bypass flow regulators continues exiting said outer annular drill collar flow channels.

10. A method for generating pressure pulses flowing within a drill string, comprising the steps of first using a pulsing fracturing/drilling (PFD) generating device longitudinally and axially positioned within an annular drill collar flow channel in a region above the drill bit a positive displacement motor or a rotary steerable tool; situated either near the formation of interest requiring injection for tertiary recovery or situated adjacent to a formation requiring fracturing such that the pulsing/fracturing/drilling (PFD) medium (liquid or gas) flows through said annular drill collar flow channel wherein guiding said PFD medium into two sets of selectively reversible flow, pilot and lower flow connecting channels, wherein said connecting channels are connected to a guide pole channel and said annular drill collar flow channel, and wherein during a next step flow through said annular drill collar flow channel is acted upon by one or more flow throttling devices (FTD's) thereby transmitting signals, wherein said device utilizes a turbine residing near and within proximity of a flow diverter that diverts said PFD medium in said annular drill collar flow channel into and away from turbine blades such that the force of said PFD medium causes said turbine blades and said turbine to rotationally spin around a coil assembly.

11. The method of claim 10, wherein said apparatus for generating pulses includes a pilot actuator assembly including, a pilot, a double rolling bellows, a flow throttling device (FTD), a bellows chamber, and a pulser guide pole, wherein pilot and lower flow connecting channels provide for reversal of flow and wherein said pilot seals a middle annular drill collar flow channel from said lower annular drill collar flow channel and such that said flow throttling device (FTD) and said pilot are capable of bi-directional axial movement along or within said pulser guide pole.

12. The method of claim 11, wherein said coil assembly generates electrical power for operating a motor and other operating equipment useful for instrumentation, said motor comprising a drive shaft centrally located between said motor and a magnetic pressure coupling wherein said motor and said coupling are mechanically coupled such that said motor rotates said magnetic pressure coupling outer magnets and moves said pilot actuator assembly.

13. The method of claim 11, wherein a magnetic coupling is formed by a location external and internal to said magnetic pressure cup where outer magnets are placed in relation to inner magnets, said inner magnets located in a position inside a magnetic pressure cup, said coupling allowing for translating rotational motion of said motor and outer magnets to linear motion of said inner magnets via a magnetic polar interaction, wherein linear motion of said inner magnets move said pilot actuator assembly, thereby linearly moving a pilot into a pilot seat, closing a pilot seat orifice, lifting a flow throttling device (FTD) into a flow throttling orifice and thereby generating a pulse wherein further rotation of said motor drive shaft, and outer magnets move said pilot actuator assembly and said pilot away from said pilot seat causing said flow throttling device (FTD) to move away from said flow throttling orifice, thereby ending the positive pulse.

14. The method of claim 11, wherein said apparatus includes a pulser guide pole capable of providing a path for said pilot and said flow throttling device (FTD) for operation in a bi-directional axial movement.

15. The method of claim 11, wherein said pilot actuator assembly is comprising of a rear pilot shaft, front pilot shaft, and pilot.

16. The method of claim 11, wherein differential pressure is minimal in that slight force acting on a small cross-sectional area of a pilot seat defines a pressure that is required to either engage or disengage said pilot.

17. The method of claim 10, wherein said flow throttling device (FTD) is without said drill collar where the PFD medium flows into a flow guide and into the upper annular drill collar flow channel and also into a pulser guide pole such that said PFD medium from said annular drill collar flow channel flows through outer annular drill collar flow channels when said flow throttling device (FTD) is in the open position and not in contact with a flow throttling device (FTD) seat.

18. The method of claim 10, wherein when said flow throttling device (FTD) is in the open position said PFD medium flows unrestricted around flow throttling device (FTD) bypass flow regulators and wherein said PFD medium from said bypass flow regulators continues exiting said outer annular drill collar flow channels.

* * * * *